US005150653A

United States Patent [19]

Hara

[11] Patent Number: 5,150,653

[45] Date of Patent: Sep. 29, 1992

[54] METHOD OF AND APPARATUS FOR CLEANING A CYLINDER

[75] Inventor: Akira Hara, Tokyo, Japan

[73] Assignee: B-J Trading Limited, Tokyo, Japan

[21] Appl. No.: 833,551

[22] Filed: Feb. 10, 1992

Related U.S. Application Data

[62] Division of Ser. No. 249,953, Sep. 27, 1988.

[30] Foreign Application Priority Data

Nov. 6, 1987 [JP] Japan ..... 62-280644

[51] Int. Cl.[5] ..... B41F 35/00

[52] U.S. Cl. ..... 101/483; 101/425; 15/256.52; 355/283

[58] Field of Search ..... 101/483, 424, 425; 15/256.51, 256.52, 256.53; 355/283

[56] References Cited

U.S. PATENT DOCUMENTS

| | | | |
|---|---|---|---|
| 2,525,982 | 4/1948 | Westcott . | |
| 2,728,103 | 12/1955 | Benedict et al. | 15/256.53 |
| 3,672,764 | 6/1972 | Hartwig et al. | 15/256.51 |
| 3,766,592 | 10/1973 | Suzuki | 15/256.51 |
| 4,135,448 | 1/1979 | Moestue | 101/425 |
| 4,344,361 | 8/1982 | MacPhee et al. | 15/256.51 |
| 4,555,989 | 12/1985 | Marass et al. | 101/424 |
| 4,651,644 | 3/1987 | Kaempfe et al. . | |
| 4,757,763 | 7/1988 | MacPhee et al. | 15/256.51 |
| 4,867,064 | 9/1989 | Hara et al. . | |
| 4,920,880 | 5/1990 | Hara et al. . | |
| 4,922,821 | 5/1990 | Nozawa et al. | 101/425 |
| 4,986,182 | 1/1991 | Sawaguchi et al. . | |
| 5,012,739 | 5/1992 | Loos et al. . | |

FOREIGN PATENT DOCUMENTS

| | | | |
|---|---|---|---|
| 476011 | 8/1951 | Canada . | |
| 1179223 | 9/1961 | Fed. Rep. of Germany . | |
| 2025513 | 12/1970 | Fed. Rep. of Germany | 15/256.52 |
| 2803370 | 8/1979 | Fed. Rep. of Germany | 15/256.53 |
| 3005469 | 2/1980 | Fed. Rep. of Germany . | |
| 1489593 | 6/1967 | France . | |
| 2285997 | 4/1976 | France . | |
| 2284452 | 5/1976 | France . | |
| 4725393 | 7/1972 | Japan | 15/256.53 |
| 5637068 | 4/1982 | Japan . | |
| 5637069 | 4/1982 | Japan . | |
| 59-199279 | 11/1984 | Japan . | |
| 1149396 | 4/1969 | United Kingdom . | |

*Primary Examiner*—Eugene H. Eickholt
*Attorney, Agent, or Firm*—Morgan & Finnegan

[57] ABSTRACT

A method of cleaning a cylinder of a printing machine comprises the steps of pressing a cleaning cloth onto the outer peripheral surface of the cylinder while the cylinder is rotating; forwardly feeding the cleaning cloth so as to wipe off contaminant on the outer peripheral surface of the cylinder; and partially feeding backwardly the portion of the cleaning cloth which has been fed forwardly during the preceding cleaning operation, before the next cleaning operation is started, whereby the portion of the cleaning cloth is partially used again for the cleaning in the next cleaning operation. The apparatus comprises a continuous cleaning cloth stretched between a cleaning cloth supply device and a cleaning cloth take-up roll rotatably supported by side plates, a take-up mechanism for rotating the cleaning cloth take-up roll so as to take-up the cleaning cloth; pressing device for selectively pressing the cleaning cloth into contact with the outer peripheral surface of the cylinder; and backward feeding device for backwardly feeding part of the cleaning cloth taken-up by the cleaning cloth take-up roll during preceding cleaning operation towards the cleaning cloth supply device after completion of the preceding cleaning operation.

1 Claim, 24 Drawing Sheets

METHOD OF AND APPARATUS FOR CLEANING A CYLINDER

This is a divisional of co-pending application Ser. No. 07/249,953 filed Sep. 7, 1988.

BACKGROUND OF THE INVENTION

1. Field of the Invention

The present invention relates to a method of and apparatus for cleaning a cylinder and a roller of a printing machine. More particularly, the present invention is concerned with a method of and apparatus for cleaning a cylinder of an offset printing machine by pressing a cleaning cloth onto the outer peripheral surface of the blanket by means of a pressure pad. Still more particularly, the present invention pertains to a method of and apparatus for backward feeding the cleaning cloth in a cleaning system of the type mentioned above.

2. Description of the Prior Art

A typical known printing cylinder cleaning apparatus will be described hereinunder. Although the following description is concentrated specifically on an apparatus for cleaning a blanket cylinder of an offset printing machine, it is to be understood that the same printing cylinder cleaning apparatus can be used for cleaning other types of cylinders.

An offset printing machine usually has three cylinders, namely, a plate cylinder, a blanket cylinder and an impression cylinder. These cylinders are arranged such that their axes extend in parallel with one another and such that they can be brought into mutual contact. A printing plate made of, for example, a type alloy or aluminum is wound on the plate cylinder, while a sheet-like blanket such as of rubber is wound on the blanket cylinder. The printing plate has a grained surface and is provided with a water repellent layer carrying an image of characters or a picture. The surface of the printing plate other than portions having images of characters or picture is dampened as water is supplied to the surface of the printing plate by means of dampening device. An oily ink is applied to the surface of the printing plate by means of an inking device. The ink will attach to the portion of the plate surface carrying the image because this area is not dampened, but will be repelled by other portions of the plate surface due to the water content held by the grained surface. The ink thus held on the plate cylinder is transferred to the blanket cylinder and is further transferred to a printing paper which passes through the nip between the blanket cylinder and the impression cylinder. This is the principle of offset printing.

As the offset printing machine operates long, the blanket surface is contaminated due to accumulation of residual ink.

In order to obviate this problem, an apparatus has been developed which is capable of cleaning the blanket cylinder.

This apparatus has a cleaning cloth supply roll and a cleaning cloth take-up roll arranged in a pair on a pair of side plates which are mounted on the frame of the printing machine. A continuous cleaning cloth is wound at its both ends on these rolls and are suitably tensed between these rolls. The cleaning cloth take-up roll is driven by a driving device to rotate at a predetermined speed and intermittently, e.g., once every 3 seconds. A stay having a substantially T-shaped cross-section is provided to extend in the direction of axes of these rolls.

Both ends of the stay are fixed to the adjacent side plates. The portion of the stay opposing to the blanket cylinder is made hollow, and the surface facing the blanket cylinder is hermetically lined with a pressure pad made of an elastic member. A plenum chamber which is defined by the end of the stay and the pressure pad is communicated with an external air compressor. As the air compressor operates, compressed air is supplied to the plenum chamber so that the pressure pad is expanded, whereby the cleaning cloth sliding on the outer surface of the pressure pad is pressed against the blanket cylinder so as to wipe off contaminant on the blanket wound on the blanket cylinder thereby cleaning the blanket surface. The pressure pad is made of an elastic resin or a rubber so that it elastically presses the cleaning cloth onto the surface of the blanket cylinder.

In a standard sheet offset printing machine, the cleaning cloth is fed intermittently, e.g., once for every three rotations of the blanket cylinder, by about 5 mm in each feeding cycle. Each cleaning cycle usually has, for example, 20 cycles of feed on the cleaning cloth. This means that about 100 mm of the cleaning cloth is consumed in each cycle of cleaning operation. In case of a newspaper offset printing press, about 450 mm of cleaning cloth is consumed in each cleaning cycle, though detailed numerical data is not shown.

The cleaning cloth has to meet various requirements such as high tensile strength, dimensional precision and wettability and, therefore, is usually made of an expensive material such as a non-woven fabric. This undesirably raises the running cost of the printing machine.

SUMMARY OF THE INVENTION

Accordingly, an object of the present invention is to provide a method of and an apparatus for cleaning a cylinder of a printing machine, wherein used portion of a cleaning cloth is fed backward partially so as to be used repeatedly, thereby reducing the consumption of the cleaning cloth.

To this end, according to one aspect of the present invention, there is provided a method of cleaning a cylinder by pressing a cleaning cloth onto the outer peripheral surface of the cylinder while the cylinder is rotating and forwardly feeding the cleaning cloth so as to wipe off contaminant on the outer peripheral surface of the cylinder, comprising: partially feeding backwardly the portion of the cleaning cloth which has been fed forwardly during the preceding cleaning operation, before the next cleaning operation is started, whereby the portion of the cleaning cloth is partially used again for the cleaning in the next cleaning operation.

According to another aspect of the present invention, there is provided an apparatus for cleaning a cylinder having a continuous cleaning cloth stretched between a cleaning cloth supply means and a cleaning cloth take-up roll rotatably supported by side plates, a take-up mechanism for rotating the cleaning cloth take-up roll so as to take-up the cleaning cloth, and pressing means for selectively pressing the cleaning cloth into contact with the outer peripheral surface of the cylinder, the apparatus comprising backward feeding means for backwardly feeding part of the cleaning cloth taken-up by the cleaning cloth take-up roll during preceding cleaning operation towards the cleaning cloth supply means after completion of the preceding cleaning operation.

Thus, a predetermined length of the cleaning cloth is fed during one cleaning cycle. The portion of this length of the cleaning cloth, which was made to contact with the cylinder in the beginning part of the cleaning cycle, is usually heavily contaminated, i.e., saturated with contaminant, but the contamination becomes less heavy towards the trailing end of the cleaning cloth. Thus, the portion of the cleaning cloth which was brought into contact with the cylinder in later part of the cleaning cycle, e.g., the trailing half portion of the cleaning cloth fed in each cleaning cycle, still has a substantial capability for wiping off the contaminant. According to the invention, the cleaning cloth is fed backward by a length which, for example, corresponds to half the length fed during the preceding cleaning cycle, so as to be used again for the cleaning purpose.

The above and other objects, features and advantages of the present invention will become clear from the following description of the preferred embodiments when the same is read in conjunction with the accompanying drawings.

DESCRIPTION OF THE PREFERRED EMBODIMENTS

A first embodiment of the invention, suitable for cleaning the blanket cylinder of an offset printing machine, will be described hereinunder with reference to the drawings.

An offset printing machine has three cylinders, namely, a plate cylinder, a blanket cylinder and an impression cylinder. These cylinders are arranged such that their axes extend in parallel with one another and such that they can be brought into mutual contact. A printing plate is wound on the plate cylinder, while a sheet-like blanket is wound on the blanket cylinder. In operation, an ink is applied to the surface of the printing plate and is transferred to the blanket cylinder and is further transferred to a printing paper whereby the printing is executed.

Figure 1:
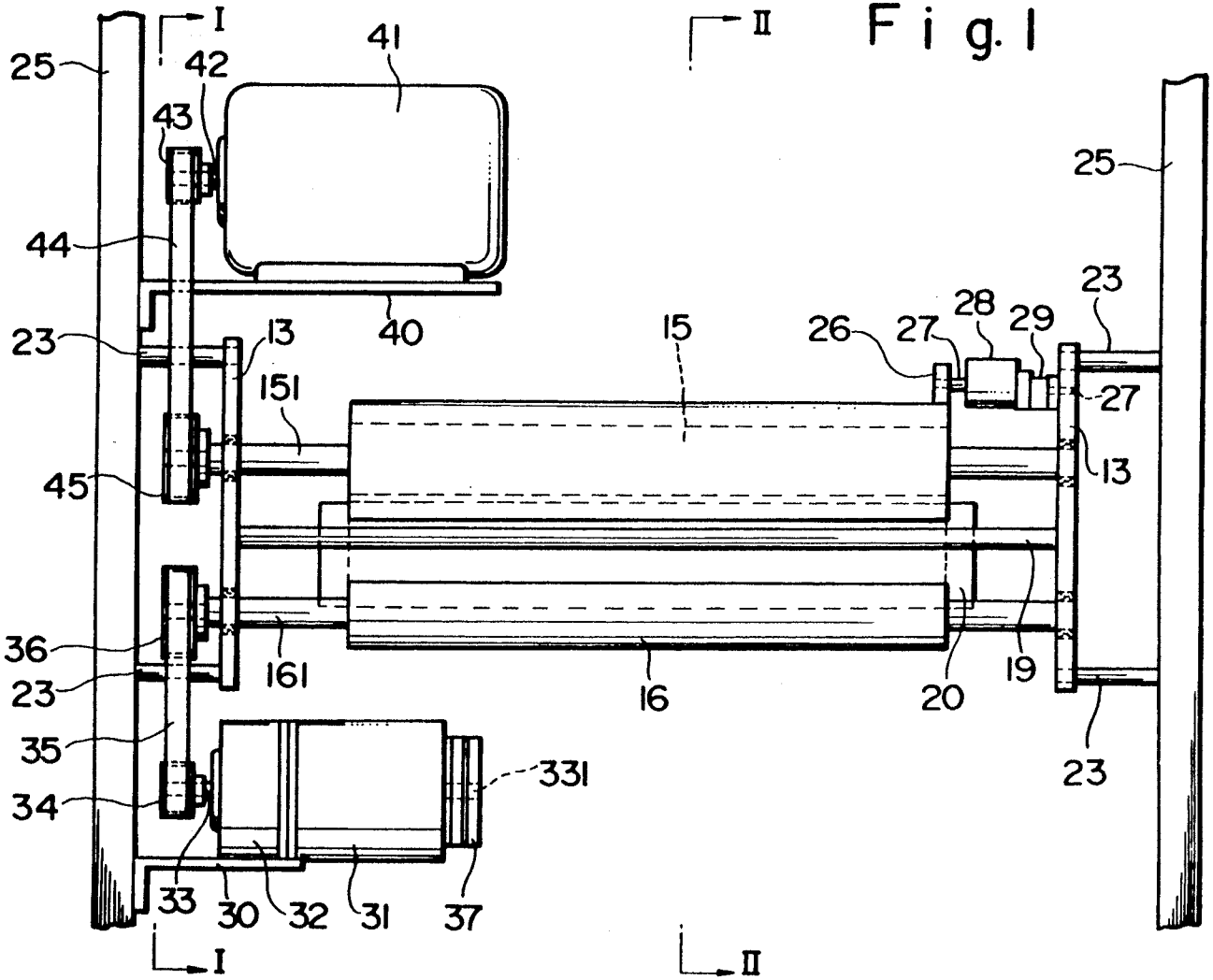
FIG. 1 is a front elevational view of a first embodiment of the present invention.
Figure 3:
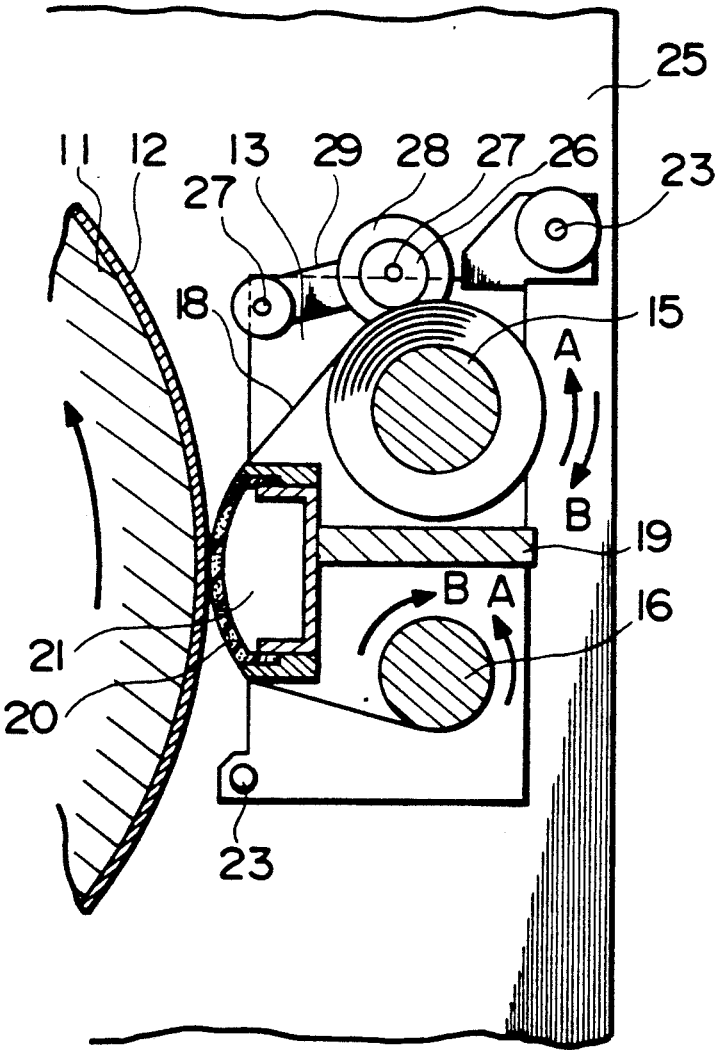
FIG. 3 is a sectional view taken along the line II—II of FIG. 1.

Referring now to FIGS. 1 and 3, a known printing cylinder cleaning apparatus has a cleaning cloth supply roll 15 and a cleaning cloth take-up roll 16 carried by shafts 151 and 161 arranged in a pair on a pair of side plates 13 which are mounted on the frame 25 of the printing machine. These rolls 15 and 16 are disposed in parallel with each other and are mounted rotatably on the shafts 151 and 161. A continuous cleaning cloth 18 is wound at its both ends on these rolls 15 and 16 and is suitably tensed between these rolls. The shaft 161 of the cleaning cloth take-up roll is driven by a driving device to rotate at a predetermined speed and intermittently once every 3 seconds. A stay 19 having a substantially T-shaped cross-section is provided to extend in the direction of axis of these rolls 15 and 16. Both ends of the stay 19 are fixed to the adjacent side plates 13. The portion of the stay 19 opposing to the blanket cylinder 11 is made hollow, and the surface facing the blanket cylinder 11 is hermetically lined with a pressure pad 20 made of an elastic member. A plenum chamber 21 which is defined by the end of the stay and the pressure pad 20 is communicated with an external air compressor (not shown). As the air compressor operates, compressed air is supplied to the plenum chamber 21 so that the pressure pad 20 is expanded, whereby the cleaning cloth 18 sliding on the outer surface of the pressure pad 20 is pressed against the blanket cylinder 11 so as to wipe off contaminant on the blanket 12 wound on the blanket cylinder 11 thereby cleaning the blanket surface.

This known cylinder cleaning system suffers from a problem in that the running cost is raised due to large amount of consumption of the cleaning cloth which is superior in quality and, accordingly, expensive.

This problem, however, can be overcome by the present invention as will be understood from the following description of the preferred embodiments.

FIRST EMBODIMENT

A description will be made as to the first embodiment in which the cleaning cloth is fed backward by the power of a rewinding motor.

The construction will be described with reference to FIGS. 1 and 2. A timing pulley 45 is attached to one end of the shaft 151 of the cleaning cloth supply roll 15. A timing belt 44 is stretched between the timing pulley 45 and another timing pulley 43 which is attached to the shaft of a rewinding motor 41.

Figure 2:
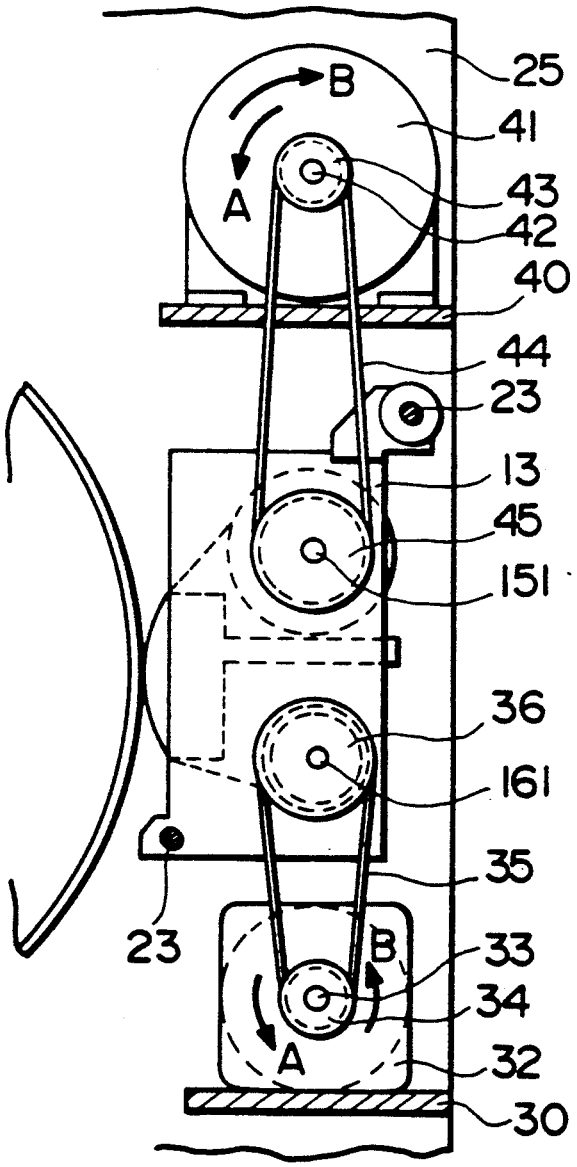
FIG. 2 is a sectional view taken along the line I—I of FIG. 1.

The rewinding motor 41 is supplied with electric current such that it always produce an output torque in the direction of an arrow B (see FIG. 2).

A timing pulley 36 is attached to the end of the shaft 161 of the cleaning cloth take-up roll 16. A timing belt 35 is stretched between the timing pulley 36 and a timing pulley 34 which is attached to the output shaft of a take-up motor 31.

An electromagnetic brake 37 is attached to the other end of the shaft 331 of the take-up motor 31 so as to brake the rotor of the take-up motor 31.

A rubber wheel 26 carried by the shaft 27 of the encoder 28 is pressed onto the outer peripheral surface of the roll of the cleaning cloth 18 on the cleaning cloth supply roll 15. The rubber wheel 26 is resiliently pressed onto the cleaning cloth by a suitable pressing means (not shown) such as a spring, so that it rotates as the cleaning cloth 18 is fed forward, thereby to detect the length of forward feed of the cleaning cloth 18.

The sequence of operation of the respective parts will be explained hereinunder with reference to FIGS. 4, 5, 6, 7, 8 and 9.

Figure 4:
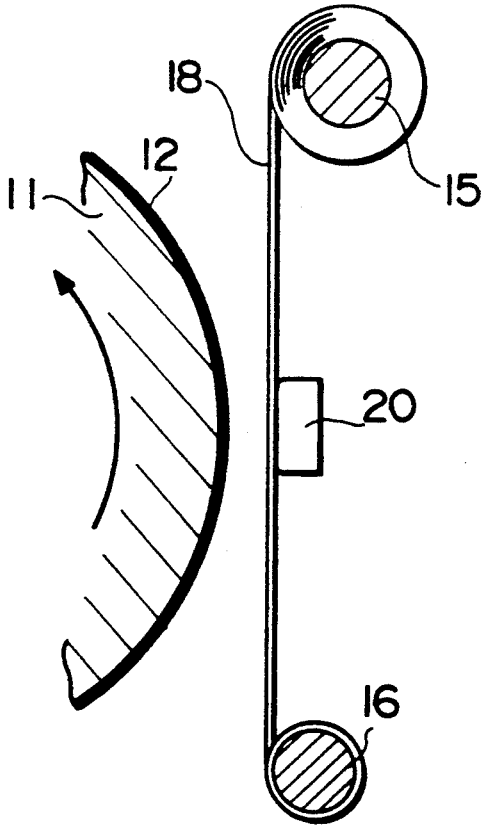
FIGS. 4 to 9 are illustrations of the operation of the first embodiment.

State Before Cleaning (Cleaning System does not Operate, see FIG. 4)

The plenum chamber 21 on the back surface of the pressure pad 20 is not supplied with compressed air so that the pressure pad 20 is sufficiently spaced apart from the surface of the blanket 12. The rewinding motor 41 is supplied with electric power so that it produces a torque in the direction of the arrow B. On the other hand, the take-up motor 31 is not supplied with electric power, and its rotor is braked by the electromagnetic brake 37 which is supplied with the electric power. Therefore, the cleaning cloth 18 is not fed backward but is kept stationary under application of backward tension, i.e., in such a state that it is pulled towards the cleaning cloth supply roll, which is produced by the torque generated by the rewinding motor 41.

Figure 5:
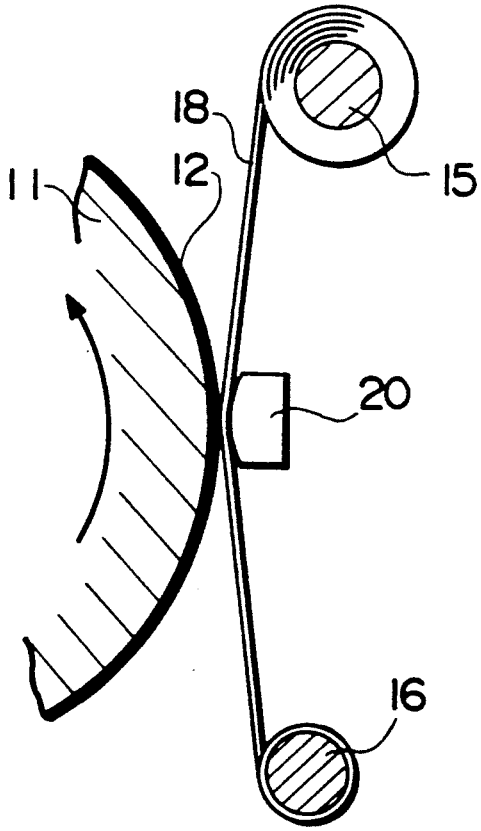
Figure 6:
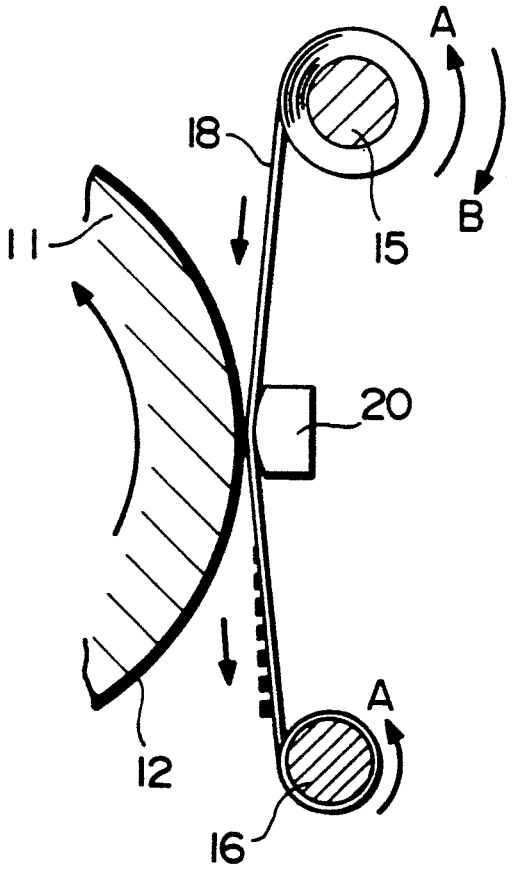

State During Cleaning (See FIGS. 5 and 6)

A cleaning start signal is given to the control system.

In response to this signal, a cleaning liquid is supplied and sprayed from a spray nozzle. The spray is executed for a predetermined times at a set interval during the period of cleaning operation.

Then, compressed air is supplied to the plenum chamber 21 so that the pressure pad 20 inflates so as to be pressed onto the contaminated surface of the blanket 12.

Subsequently, the electromagnetic brake 37 of the take-up motor 31 is de-energized to allow the rotor of the take-up motor 31 to rotate in the direction of an arrow A. Namely, the cleaning cloth take-up roll 16 rotates in the direction of the arrow A thereby taking up the cleaning cloth 18.

The rewinding motor 41 is kept energized to generate torque in the direction of the arrow B. The output torque of this motor 41, however, is smaller than the torque produced by the take-up motor 31 for taking up the cleaning cloth 18, so that the rotor of the rewinding motor 41 is reversed in the direction of the arrow A, thus allowing the cleaning cloth 18 to be fed forward in the direction of the arrow A.

During the cleaning, the cleaning cloth 18 is taken-up intermittently at a suitable interval by a predetermined length in each take-up operation, or may be taken-up continuously such that a predetermined length of the cleaning cloth 18 is taken up in the period of the cleaning operation.

In the case of a standard continuous take-up in an ordinary newspaper offset press, for example, about 450 mm of the cleaning cloth 18 is taken up in 4 minutes and 30 seconds.

Therefore, the take-up motor 31 is set such that it provides a take-up speed of about 100 mm/min, through a reduction gear 32.

The total length of feed of the cleaning cloth in each cleaning operation is about 450 mm also when the intermittent feed of cloth is adopted.

The amount of feed of the cleaning cloth 18 is detected by an encoder 28 which detects the number of rotations of a rubber wheel 26 contacting the roll of the cleaning cloth 18.

Figure 7:
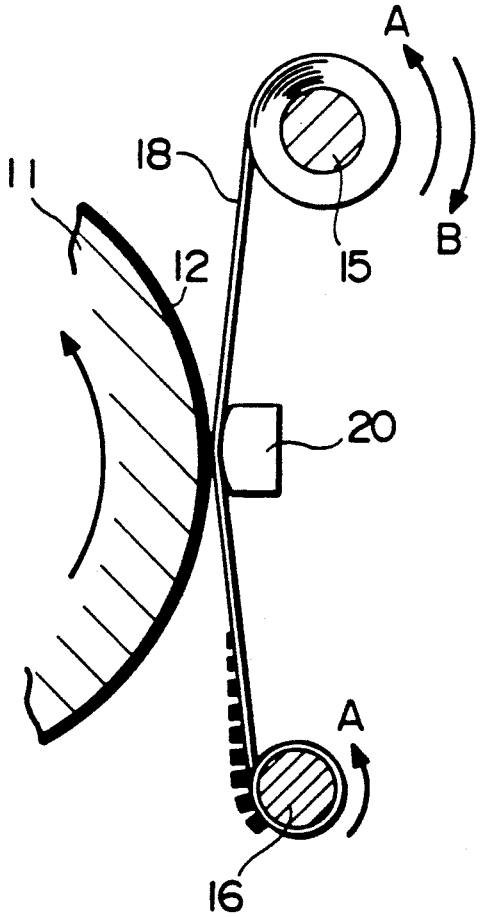
Figure 8:
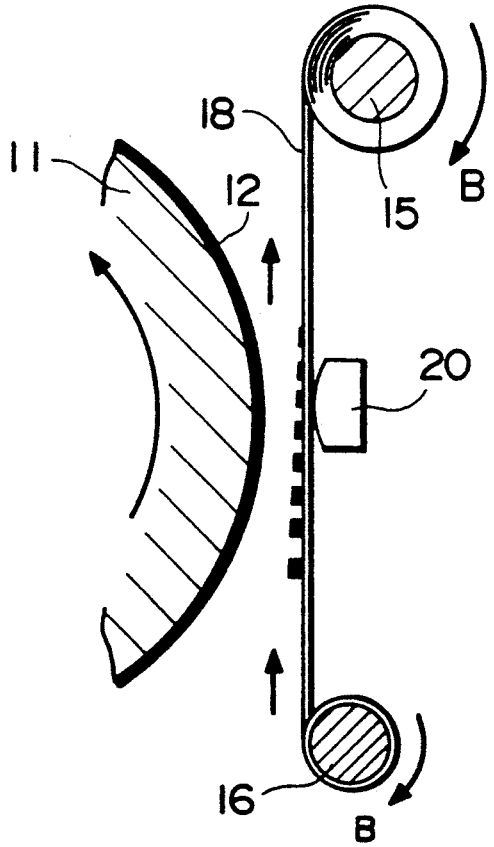
Figure 9:
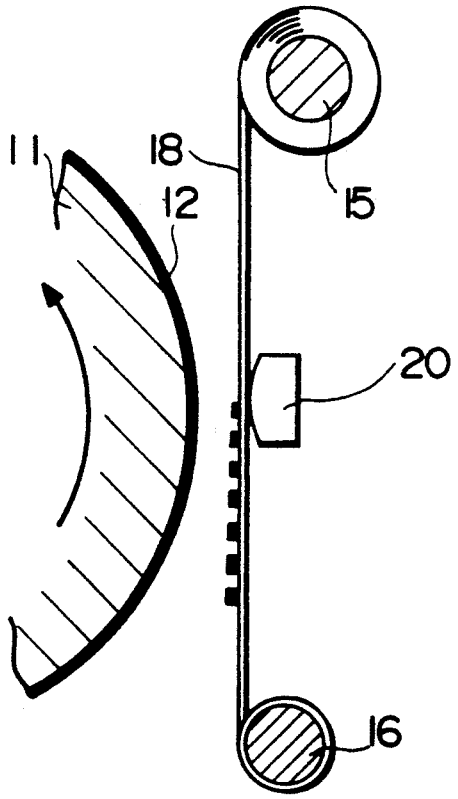
Figure 10:
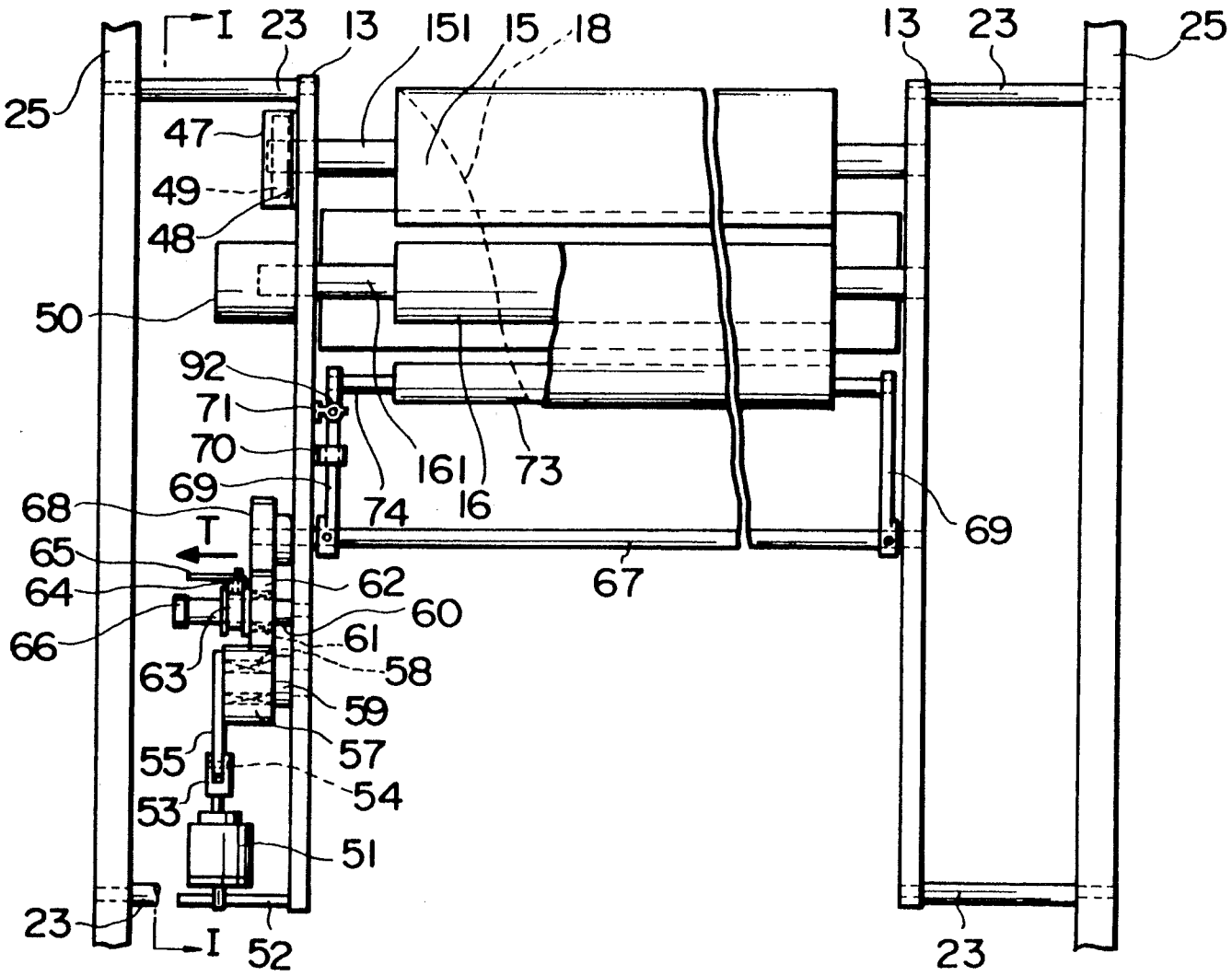
FIG. 10 is a front elevational view of a second embodiment of the present invention.
Figure 11:
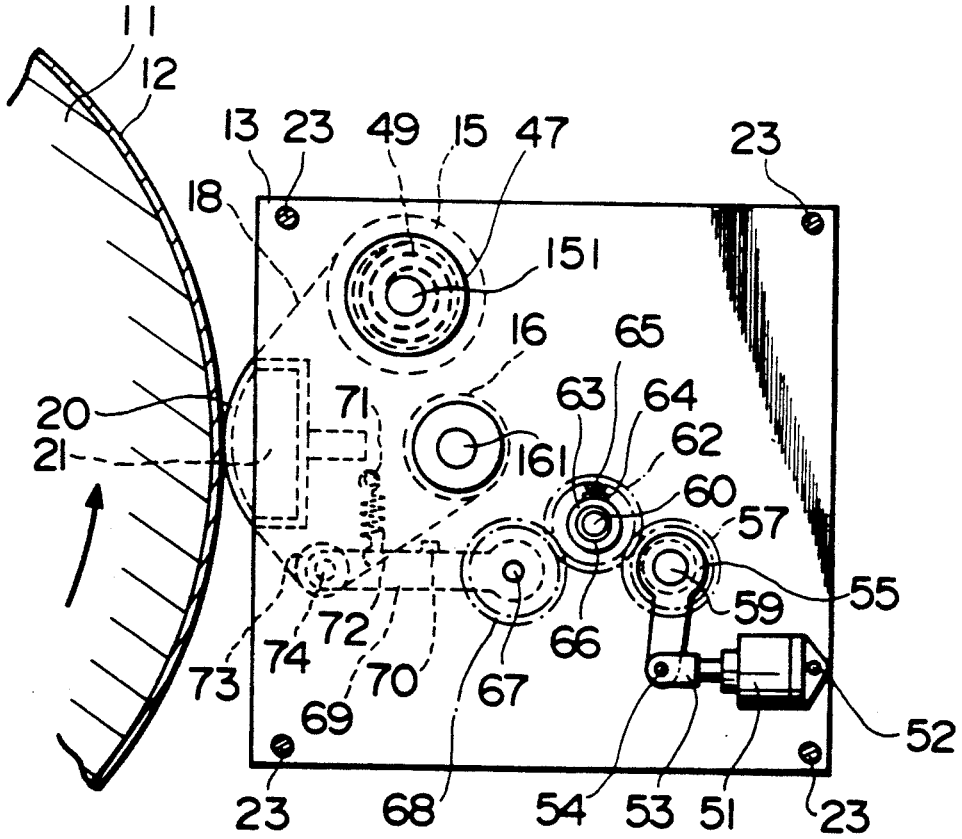
FIG. 11 is a sectional view taken along the line I—I of FIG. 10.

Completion of Cleaning and Subsequent Operation (See FIGS. 7, 8 and 9)

The encoder 28 produces a signal upon detection of a predetermined amount of the cleaning cloth 18 taken up. In response to this signal, the air is relieved from the plenum chamber 21 so that the pressure pad 20 is separated from the surface of the blanket 12.

Then, the take-up motor 31 is de-energized with the electromagnetic brake 37 kept inoperative.

Since the rewinding motor 41 is continuously energized to generate a torque in the direction of the arrow B, the cleaning cloth 18 is pulled by the cleaning cloth supply roll 15 in the direction of the arrow B, simultaneously with the extinction of the torque which has acted in the direction of the arrow A.

In consequence, the cleaning cloth 18 is fed backward. The encoder 28 produces, upon detection of the backward feed of the cleaning cloth 18 by a predetermined amount, a signal which acts to put the electromagnetic brake 37 into effect thereby braking the rotor of the take-up motor 31. In consequence, the backward feed of the cleaning cloth 18 towards the cleaning cloth supply roll 15 is ceased.

SECOND EMBODIMENT

A description will be made hereinunder as to an embodiment in which the backward feed of the cleaning cloth is effected by means of a swing roller, with specific reference to FIGS. 10 to 16.

The construction will be explained hereinunder with reference to FIGS. 10, 11, 14 and 15.

This embodiment also has a cleaning cloth supply roll 15 and a cleaning cloth take-up roll 16, as well as a pressure pad device which is constituted by a pressure pad 20, plenum chamber 21 and a stay. These members are carried by side plates 13 which in turn are fixed to and supported by frame portions 25 of a printing machine by means of a plurality of stud bolts 23.

The cleaning cloth 18 which is supplied from the cleaning cloth supply roll 15 contacts the pressure pad 20 and, is taken up by the cleaning cloth take up roll 16 after making a turn around a swing roller 73 in contact therewith.

The swing roller 73 is carried by a pair of arms 69 which are secured to a shaft 67 carried at its both ends by the side plates 13. The arm 69 is swung about the axis of the shaft 67 by means of a gear 68 which is fixed to one end of the shaft 67.

The swing arms 69 are urged upward, i.e., in the direction of an arrow Y, by means of a spring 72. The upward movement of the swing arms 69, however, is limited by a stopper 70.

A spiral spring 49 encased in a spring case 47 is secured to one end of the shaft 151 of the cleaning cloth supply roll 15. One end of the spiral spring 49 is fixed to a spring case 47 which in turn is fixed to the side plate 13. The other end of the spiral spring 49 is fixed to one end of the shaft 151 of the cleaning cloth supply roll 151, so as to urge the cleaning cloth supply roll 15 in such a direction as to rewind, i.e., to feed backward, the cleaning cloth 18.

An intermittent driving device 50 is secured to one end of the shaft 161 of the cleaning cloth taken-up roll 16 so as to positively urge the cleaning cloth take-up roll 16, i.e., in the direction for taking up the cleaning cloth 18.

The intermittent driving device 50 may be of the type which is disclosed in Japanese Patent Laid-open Publication No. 56-37069, although the detail is not shown in the drawings.

In this embodiment, the cleaning cloth supply roll 15 is driven only forwardly. Namely, it does never rotate or be driven in the backward direction, though the driving connection between the driving device 50 and the cleaning cloth supply roll 15 is manually releasable so as to allow the cleaning cloth supply roll 15 both forwardly and backwardly.

The gear 68 attached to the shaft 67 of the swing arms is drivingly connected to a gear 57 through an intermediate gear 62.

The gear 62 is shiftable along the shaft 60 and is adapted to be retained either in an engaging position where it engages with the gear 68 and a free position where it does not engage with the gear 68.

The gear 57 is carried by a gear shaft 59 through the intermediary of a one-way clutch 58.

The gear shaft 59 is rotatably supported at its one end by a side plate 13. A lever 55 is secured to the other end of the gear shaft 59. The arrangement is such that, as the lever 55 swings, a rotational motion is transmitted to the gear 57 through the gear shaft 59 and the one-way clutch 58.

In this case, the driving connection between the lever 55 and the gear 57 is achieved through the one-way clutch 58. The engagement between the clutch 58 and the gear shaft 59 is such that the torque is transmitted only when the gear shaft 59 rotates in the direction of the arrow X, whereas, when the gear shaft rotated in the counter direction Y, the gear shaft 59 only idles so that the torque is not transmitted to the gear 57.

The rocking of the lever 55 is effected by a pneumatic cylinder which is pivotally connected to the other end of the lever 55 through a pin 54. Namely, when the rod of the pneumatic cylinder 51 is retracted, i.e., swung in the direction of an arrow N, the lever 55 operates to rotationally drive the gear 57 in the direction of the arrow X so that torque is transmitted to the gear 68 to cause the swing arms 69 and, hence, the swing roller 73 to swing from a point a to a point b, thereby feeding the cleaning cloth 18 correspondingly.

The forward stroking of the rod of the pneumatic cylinder 51 as indicated by arrow M causes the lever 55 and, hence, the gear shaft 59 to rotate in the direction of the arrow Y. In this case, however, the torque is not transmitted to the gear 57 because the one-way clutch 58 idles, so that the swing roller 73 is stopped at the position b without returning to the position a.

Thus, in the second embodiment, the swing roller 73 steps in the direction of the arrow X as the rod of the pneumatic cylinder reciprocatingly moves in the directions of arrows M and N, thereby to intermittently drive the cleaning cloth 18 in the forward direction. The described arrangement will be referred to as a "primary cloth feeding mechanism".

When the primary feed of the cleaning cloth is ceased, the swing roller 73 reaches the stroke end and is held at this position.

An operation which will be referred to as "secondary feed of cloth" is then commenced. During the secondary feed of the cleaning cloth, the cleaning cloth take-up roll 16 is intermittently rotated so as to take-up a predetermined length of the cleaning cloth in each of the intermittent rotations. When a predetermined number of the take-up operations is finished, the secondary feed of the cloth is terminated and the cleaning process is completed soon thereafter.

A process which will be referred to as "backward feed of cloth" is commenced upon completion of the cleaning process. As the first step, the gear 62 is axially shifted out of engagement with the gear 68 so that the gear 68 and, hence, the shaft 67 are allowed to freely rotate. In consequence, the arms 69 are pulled by the spring 72 so as to rotate in the direction of the arrow Y into contact with the stopper 70 so as to be stationed at the initial position a.

Obviously, the cleaning cloth 18 which has been fed forward is slackened as a result of swinging of the arms 69 in the direction of the arrow Y. In the described embodiment, as explained before, the cleaning cloth supply roll 15 is urged by the spiral spring 49 in such a direction as to rewind the cleaning cloth 18, whereby the slack of the cleaning cloth 18, corresponding to the length fed by the swing roller 73 in the primary feed, is rewound and taken up by the cleaning cloth supply roll 15.

The sequence of operation of the respective portions will be described hereinunder with reference to FIGS. 12, 13, 14, 15, 16, 17 and 18.

Figure 12:
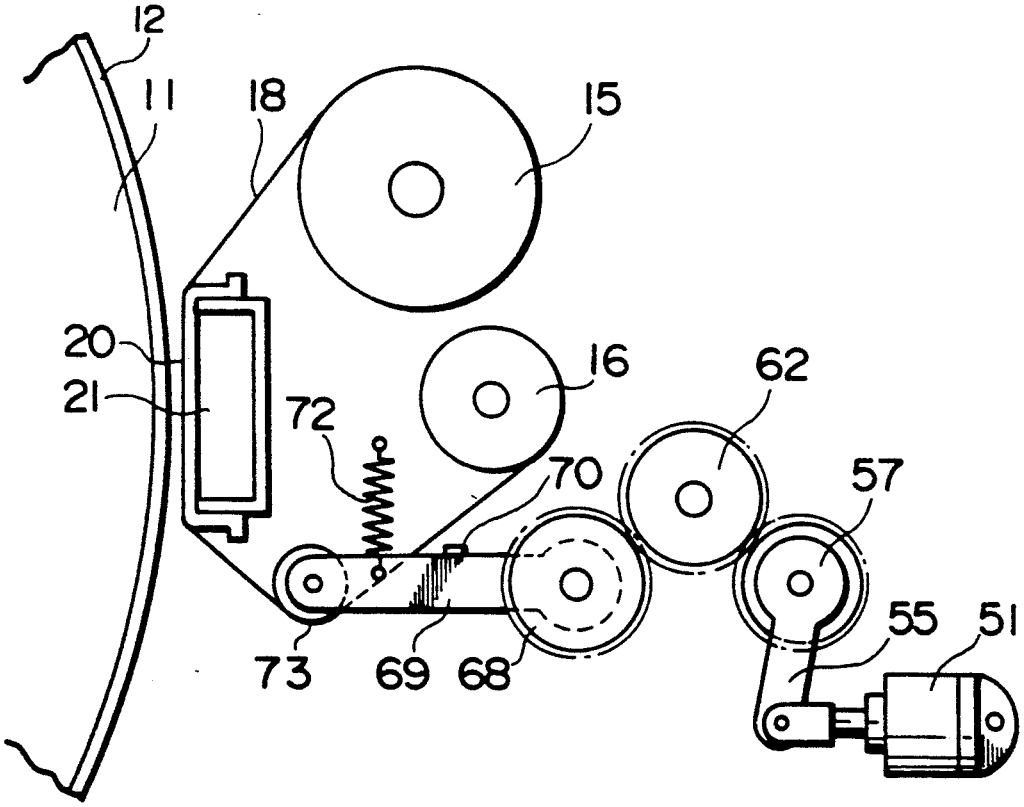
FIGS. 12 to 18 are illustrations of the operation of the second embodiment.

State Before Operation (See FIG. 12)

Figure 13:
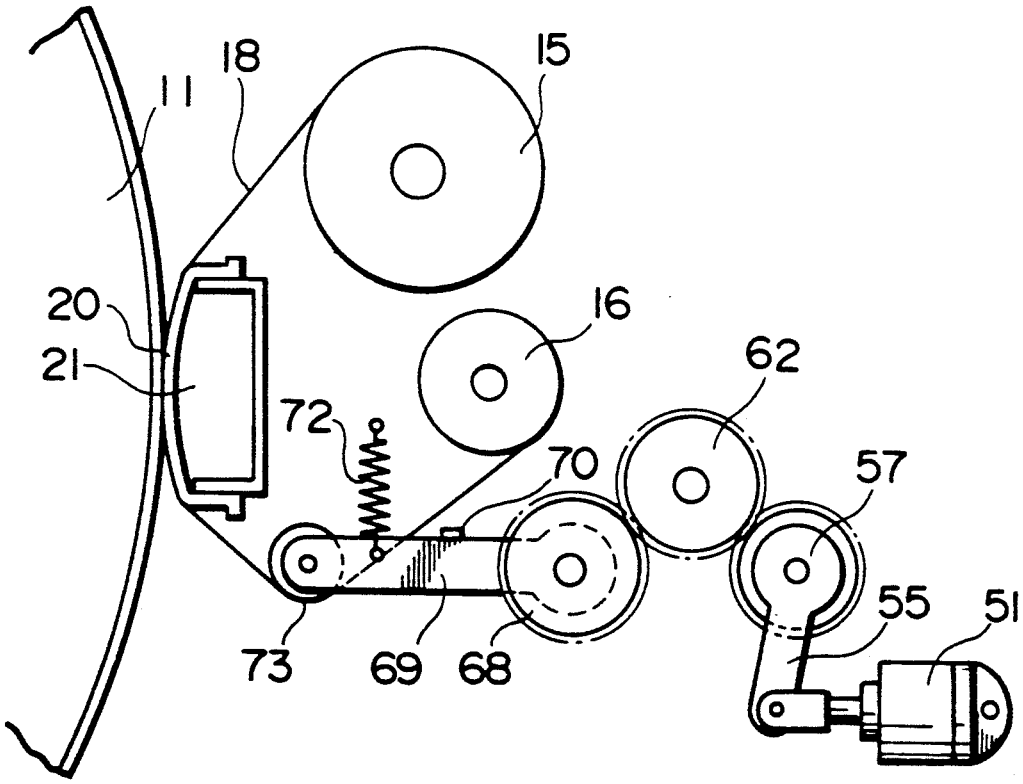

State in Which Pressure Pad 20 Is Pressed onto the Blanket 12 (See FIG. 13)

Compressed air is supplied into the plenum chamber 21 so that the pressure pad 20 inflates, whereby the cleaning cloth 18, wetted by a solvent spray bar (not shown), is brought into pressure contact with the surface of the blanket 12.

Figure 14:
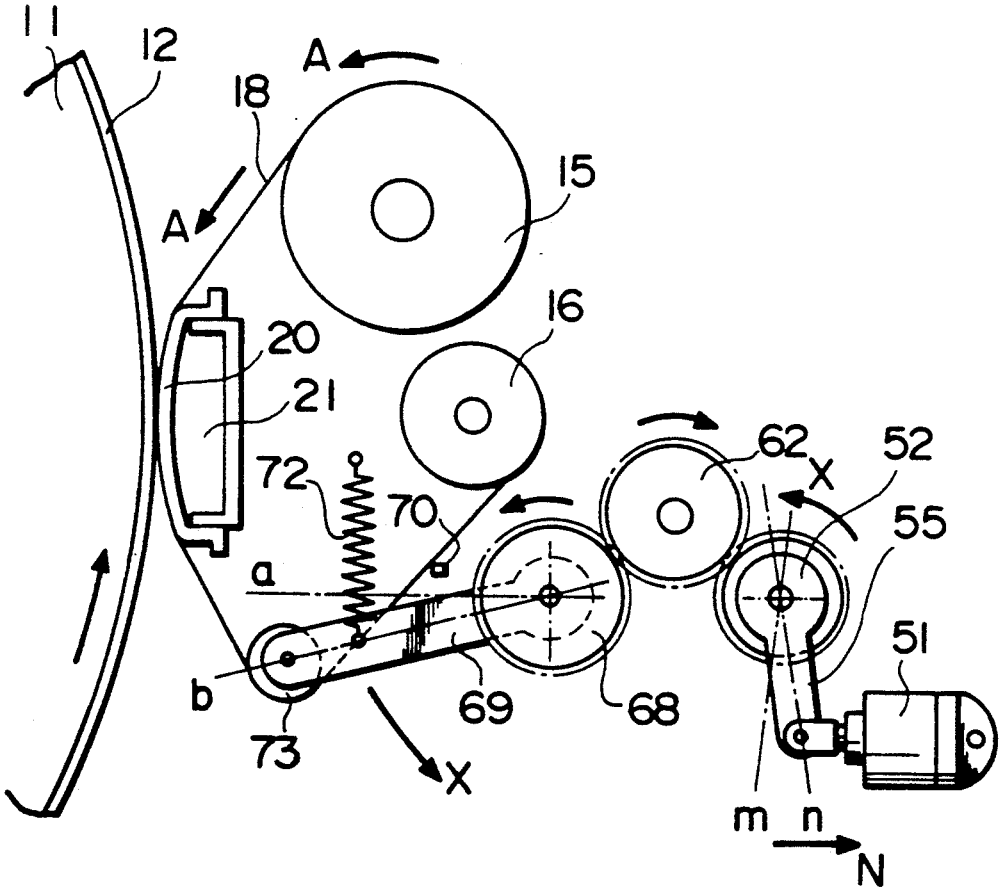

First Cycle of Primary Feed of Cleaning Cloth (See FIG. 14)

As the compressed air is supplied to the pneumatic cylinder 51, the cylinder rod of the pneumatic cylinder 51 is extended in the direction of the arrow N, thereby causing the lever 55 to swing from the position m to the position n, with the result that the gears 57, 62 and 68 are rotated in the directions of arrows through a corresponding angle. In consequence, the arm 69 fixed to the gear 68 is swung in the direction of an arrow X, whereby the swing roller 73 supported by the swing arms 69 are moved by about 3 to 5 mm from the point a to the point b. In consequence, the cleaning cloth 18 wound on the swing roller 73 is extracted from the cleaning cloth supply roll 15. Since the cleaning cloth take-up roll 16 can rotate only in the positive or forward direction, the cleaning cloth 18 does never become loose even when the swing roller 73 is lowered.

Figure 15:
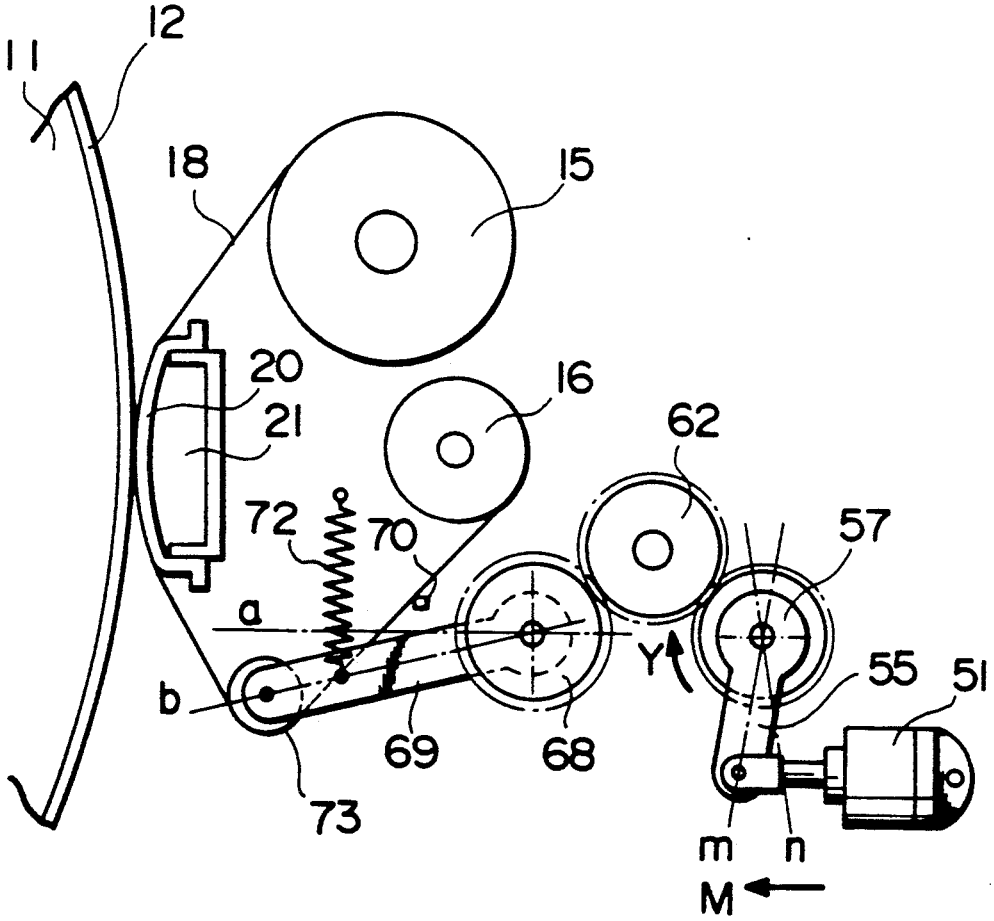

Reset of Pneumatic Cylinder After First Cycle of Primary Feed of Cleaning Cloth (See FIG. 15)

After completion of extraction of the cleaning cloth 18, the rod of the pneumatic cylinder 51 is moved in the direction of an arrow M so that the lever 55 is reset to a position m. In this case, the lever 55 and the gear 57 are engaged with each other through the one-way clutch 58 in such a manner that the torque is transmitted only when the lever 55 swings from the position m to the position n, i.e., such that the torque is not transmitted when the lever 55 swings from the position n to the position m. Therefore, the arms 69 do not swing even though the pneumatic cylinder 51 is reset, so that the swing roller 73 is kept at the position b and, therefore, the cleaning cloth 18 is driven neither forwardly nor backwardly.

Figure 16:
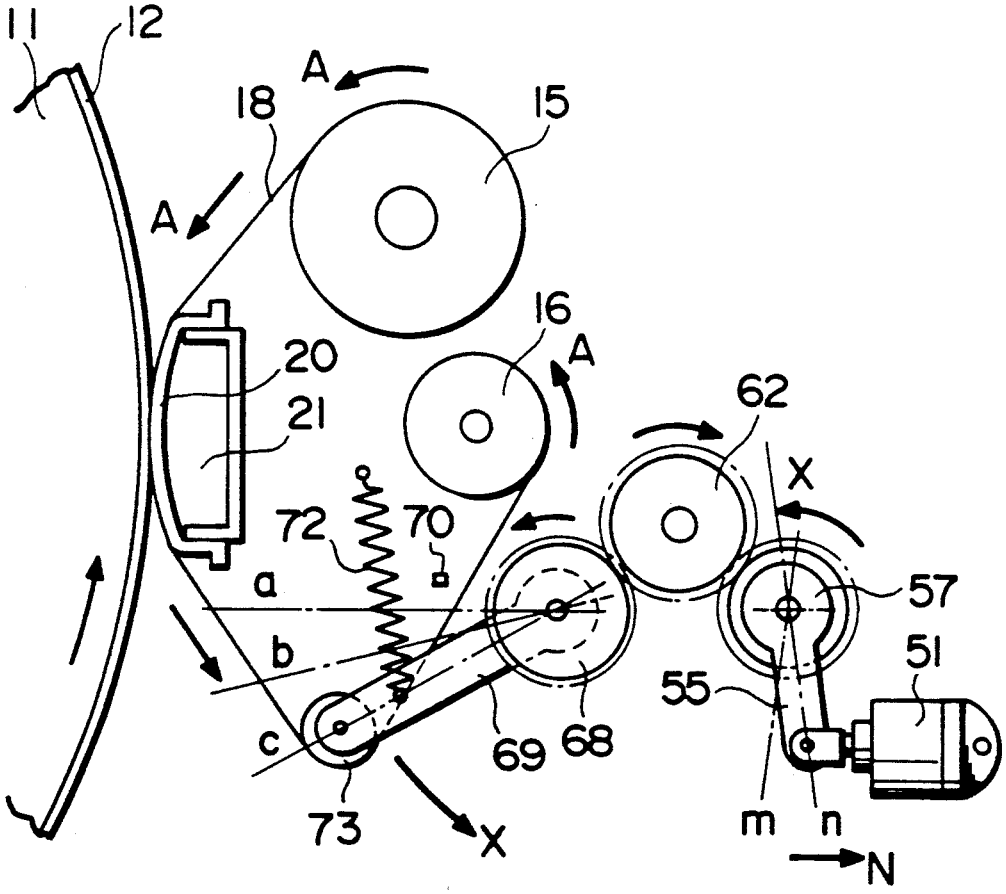

Second Cycle of Primary Feed of Cleaning Cloth (See FIG. 16)

The rod of the pneumatic cylinder 51 reset to the position m is moved again in the direction of the arrow N so as to cause the arms 69 to swing in the direction of the arrow A as in the case of the first cycle of primary feed of the cleaning cloth. In consequence, the swing roller 73 is shifted from the position b to the position c so as to extract the cleaning cloth 18 in the direction of the arrow A as in the case of the first cycle of primary feed. The described operation commencing with the first cycle of primary feed and ending in the second cycle of primary feed is repeated for a plurality of times, e.g., 5 to 6 times, so as to intermittently feed the cleaning cloth 18 forwardly, thus completing the primary feed of the cleaning cloth.

Figure 17:
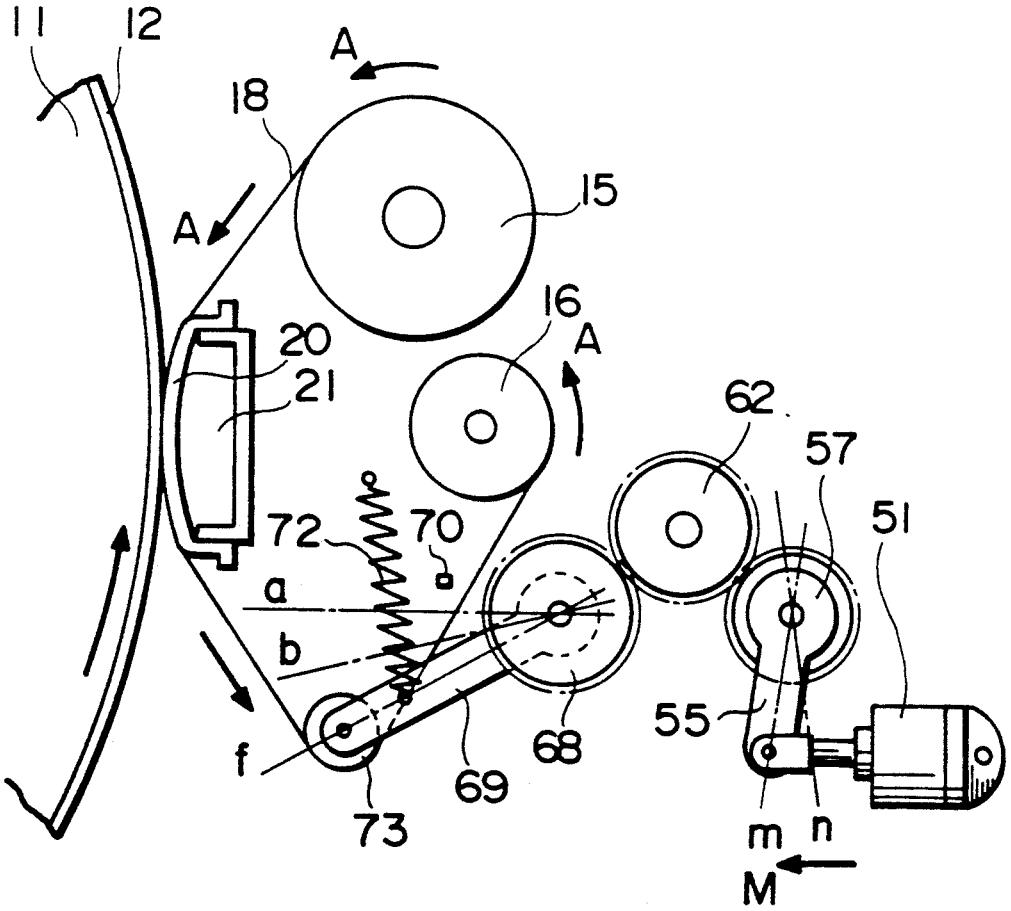

Secondary Feed of Cleaning Cloth (See FIG. 17)

The rod of the pneumatic cylinder 51 returns to the initial position m after the primary feed of the cleaning cloth is finished. At this moment, the swing roller 73 is held at a position of the terminal point f of the primary feed of the cleaning cloth. The secondary feed of the cleaning cloth is executed by driving the cleaning cloth take-up roll 16 in the direction of the arrow A. More specifically, the intermittent driving device 50 (details not shown) composed of the pneumatic cylinder 51 and other parts engages with one end of the shaft 161 of the cleaning cloth take-up roll 16 so as to effect an intermittent take-up of the cleaning cloth 18. The secondary feed of the cleaning cloth is finished when a predetermined number of cloth take-up cycles is finished. The intermittent drive device 50 may be a known one such as that disclosed in Japanese Patent Laid-open Publication No. 56-37069.

Figure 18:
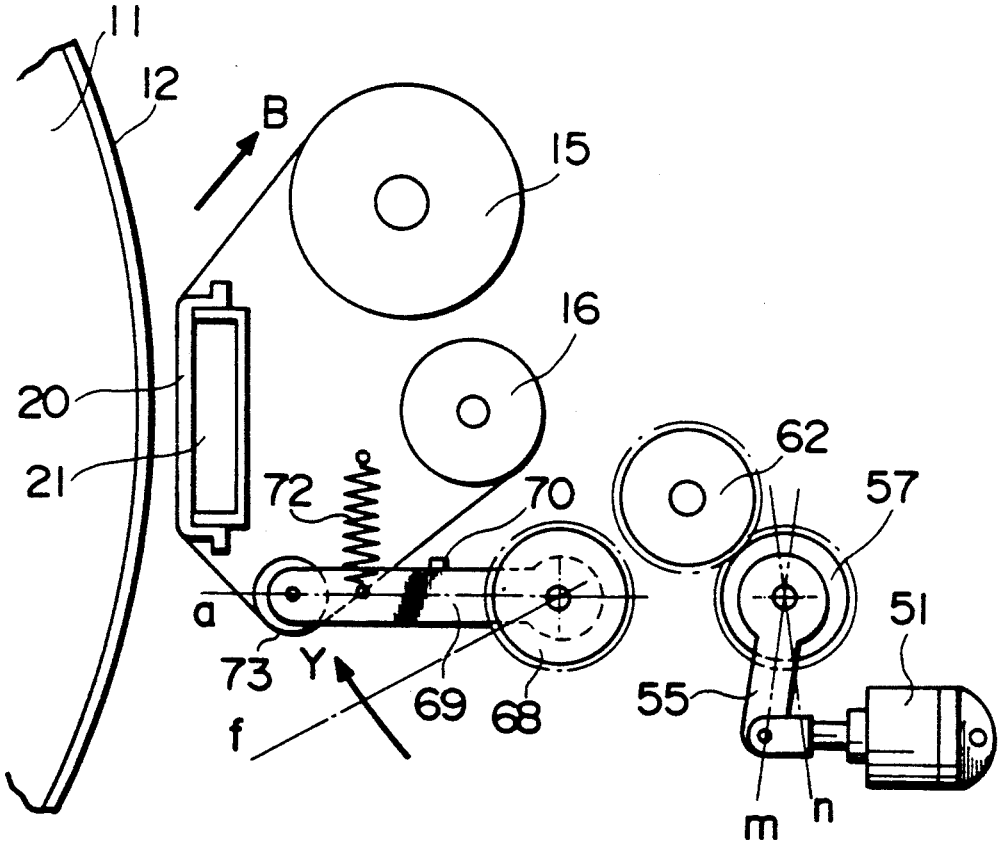

Backward Feed of Cleaning Cloth (See FIG. 18)

When a predetermined number of forward steps of the cleaning cloth 18 is finished in the secondary feed of the cleaning cloth 18, the rollers, gears, lever and arms are held in relation to one another at positions for the secondary feed of the cleaning cloth. When the cleaning process is completed, the cleaning cloth 18 is fed backward by a length which is a part of the length fed forward during the cleaning. Namely, as the first step, the air is relieved from the plenum chamber 21 which has been held in the state for the secondary feed of the cleaning cloth, so that the pressure pad 20 is retracted away from the surface of the blanket 12. Subsequently, the gear 62 is shifted by the shifter lever 65 in the direction of an arrow T so as to be disengaged from the gear 68, thereby freeing the gear 68. In consequence, the arms 69 engaging with the gear 68 through the shaft 67 are urged in the direction of the arrow Y into contact with the stopper 70, by the upward urging force of the spring 72. Thus, the arms 69 are held stationary in contact with the stopper 70. As a result, the cleaning cloth 18 is slackened at its portion between the cleaning cloth supply roll 15 and the cleaning cloth take-up roll 16. It is to be noted, however, a reversing spring case 47 is attached to the end of the shaft 151 of the cleaning cloth supply roll 15 so as to rotationally bias the cleaning cloth supply roll 15 in the direction of an arrow B. Consequently, the slack of the cleaning cloth 18 produced as a result of resetting of the swing roller 73 is taken up and rewound on the cleaning cloth supply roll 15. Obviously, the length of the slack of the cleaning cloth 18 is equal to the length of the forward feed of the cleaning cloth 18 in the primary feed of the cleaning cloth 18.

THIRD EMBODIMENT

A description will be conducted hereinunder with reference to FIGS. 19 to 24 as to a third embodiment of the present invention in which the backward feed of the cleaning cloth is effected by a vertical movement of a pair of parallel bars or guide rollers which are spaced from each other in the direction of forward feed of the cleaning cloth.

Figure 19:
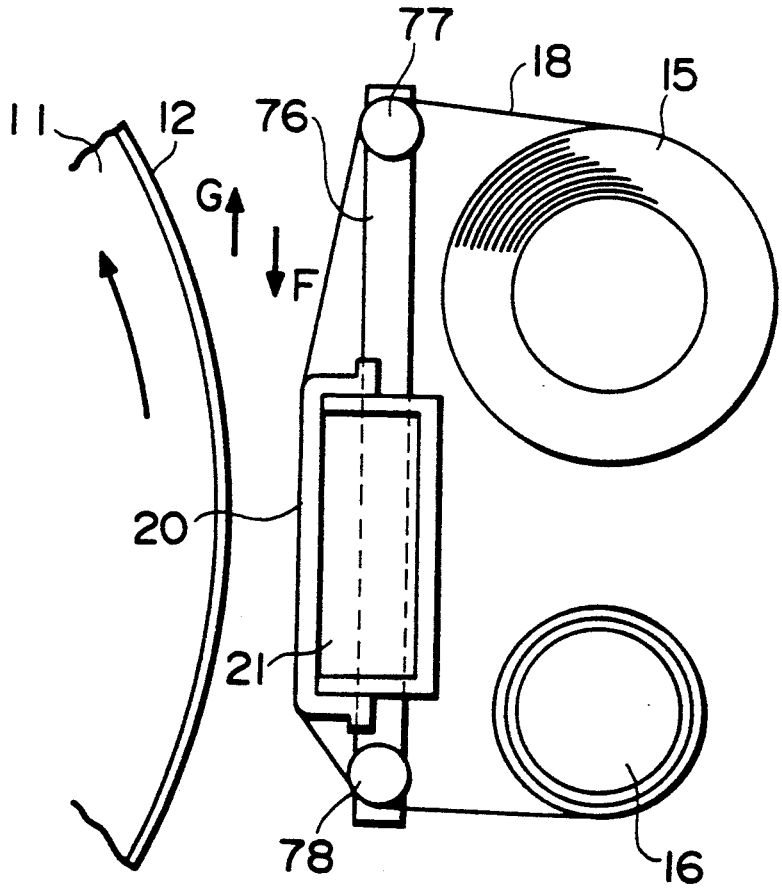
FIG. 19 is an illustration of a third embodiment of the present invention.

The construction of this embodiment will be described hereinunder with reference to FIG. 19.

An upper guide roller 77 and a lower guide roller 78 are extended in the direction orthogonal to the direction of feed of the cleaning cloth 18 and are secured to upper and lower sides of the frame 76 such as to extend in parallel with each other. The frame 76 can be moved up and down as indicated by arrows G and F, by a suitable driving mechanism (not shown). The amount of movement of the frame is about 50 mm. Other portions are materially the same as those in conventional apparatus.

The sequence of operation of this embodiment will be described with reference to FIGS. 20, 21, 22, 23 and 24.

Figure 20:
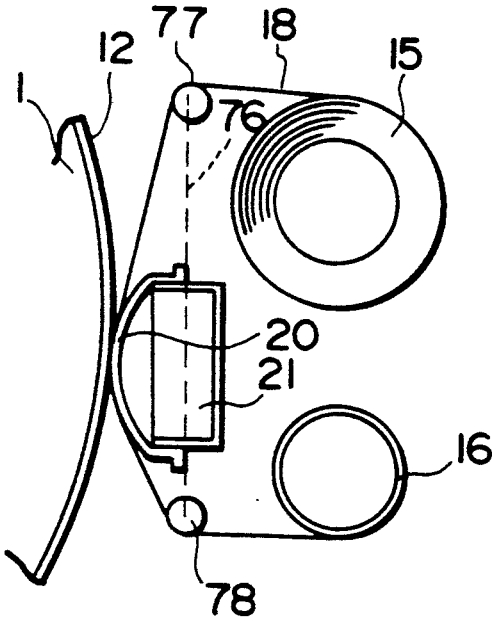
FIGS. 20 to 24 are illustrations of the operation of the third embodiment of the present invention.

Start of Cleaning (See FIG. 20)

When a cleaning start signal is given, water and a cleaning liquid is sprayed by a spray nozzle (not shown) onto the cleaning cloth 18 and, at the same time, compressed air is supplied to the plenum chamber 21. As a result, the pressure pad 20 inflates so as to press a cleaning cloth 18 onto the surface of the blanket 12.

Figure 21:
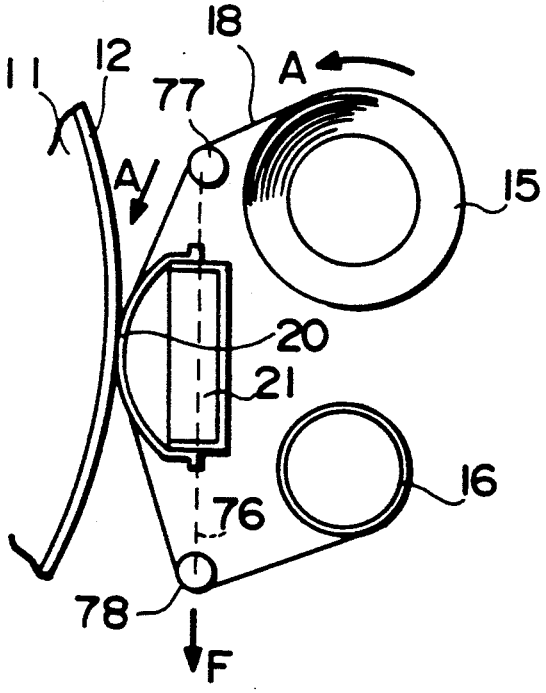

Primary Feed (See FIG. 21)

Then, the frame 76 and, hence, the upper and lower guide rollers 77 and 78 are intermittently lowered in the direction of the arrow F so as to feed the cleaning cloth 18 forwardly as indicated by an arrow A. In the case of an ordinary sheet offset printing machine, the amount of the forward feed in each feeding operation of the cleaning cloth 18 is, as a standard, about 5 mm. The cleaning liquid is sprayed during intermittent feed of the cleaning cloth. This forward feed of the cleaning cloth 18 causes the cleaning cloth supply roll 15 to rotate in the direction of the arrow A so as to pay off the cleaning cloth 18. However, the cleaning cloth take-up roll 16 does not rotate because it is latched by a unidirectional latch.

Figure 22:
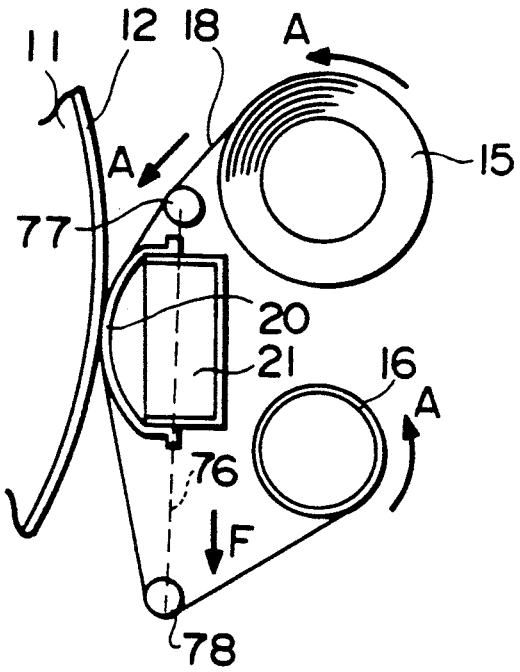

Secondary Feed (See FIG. 22)

As the primary feed of the cleaning cloth 18 goes on, the upper and lower guide rollers 77 and 78 reach the lowermost positions. The frame 76 is then stopped and held at this position.

Subsequently, the cleaning cloth take-up roll 16 is intermittently driven by a driving device (not shown) in the direction of the arrow A, whereby the cleaning cloth 18 is fed in this direction. Meanwhile, the cleaning cloth supply roll 15 is rotated in the direction of the arrow A as in the case of the primary feed. Although the primary feed is effected first followed by the secondary feed in the foregoing description, this is only illustrative and the arrangement may be such that the secondary feed is conducted first followed by the primary feed.

Figure 23:
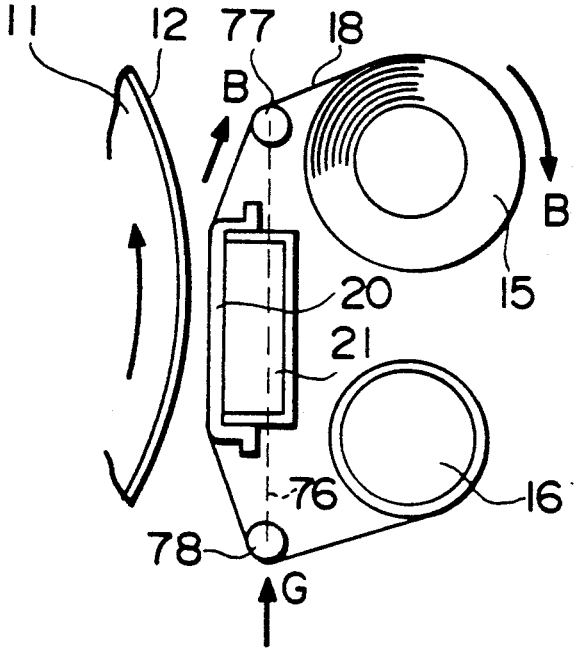

Backward Feed of Cleaning Cloth (See FIG. 23)

The cleaning operation is finished when the predetermined fed amount is reached in the secondary feed. Then, the pressure pad 20 is retracted away from the surface of the blanket 12 because the air in the plenum chamber 21 is relieved. Subsequently, the frame 76 is released so that it is moved upward as indicated by the arrow G, thus causing a slack of the cleaning cloth 18.

Since the cleaning cloth supply roll 15 is urged to rotate in the direction of the arrow B, it takes up the slack of the cleaning cloth 18 and, when the frame 76 reaches the initial position, the cleaning cloth 18 has been fed backward by an amount which is equal to the amount of the forward feed effected in the primary feed.

In this embodiment, the cleaning cloth take-up roll shaft 161 is constructed so as not to rotate backward. Therefore, the cleaning cloth 18 on the cleaning cloth take-up roll is never extracted therefrom, even when the cleaning cloth 18 is fed backward in the direction of the arrow B.

Figure 24:
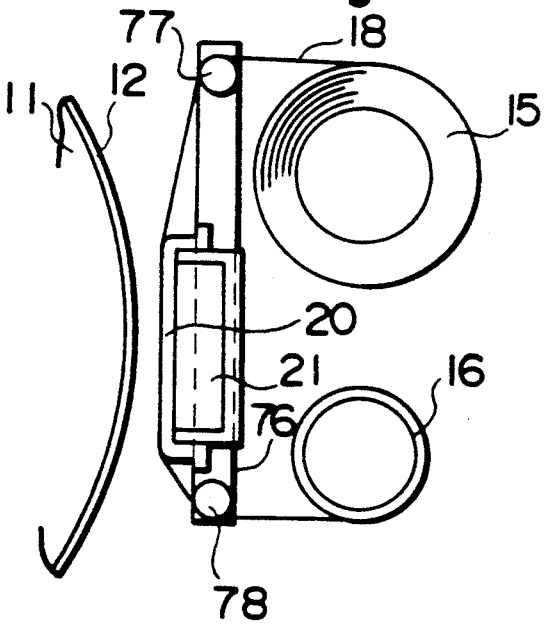

Completion of Cleaning Process and Resetting to Initial State (See FIG. 24)

When the frame 76 reaches the upper limit position again, the cleaning cloth 18 has been fed backward by the amount equal to the amount of the forward feed effected in the primary feed, thus completing the whole cleaning process. The system is then stationed for the next cleaning operation.

FOURTH EMBODIMENT

A description will be made hereinunder with reference to FIGS. 25 to 30, as to a fourth embodiment in which the primary feed is effected by a translational movement of the cleaning cloth take-up roll.

Figure 25:
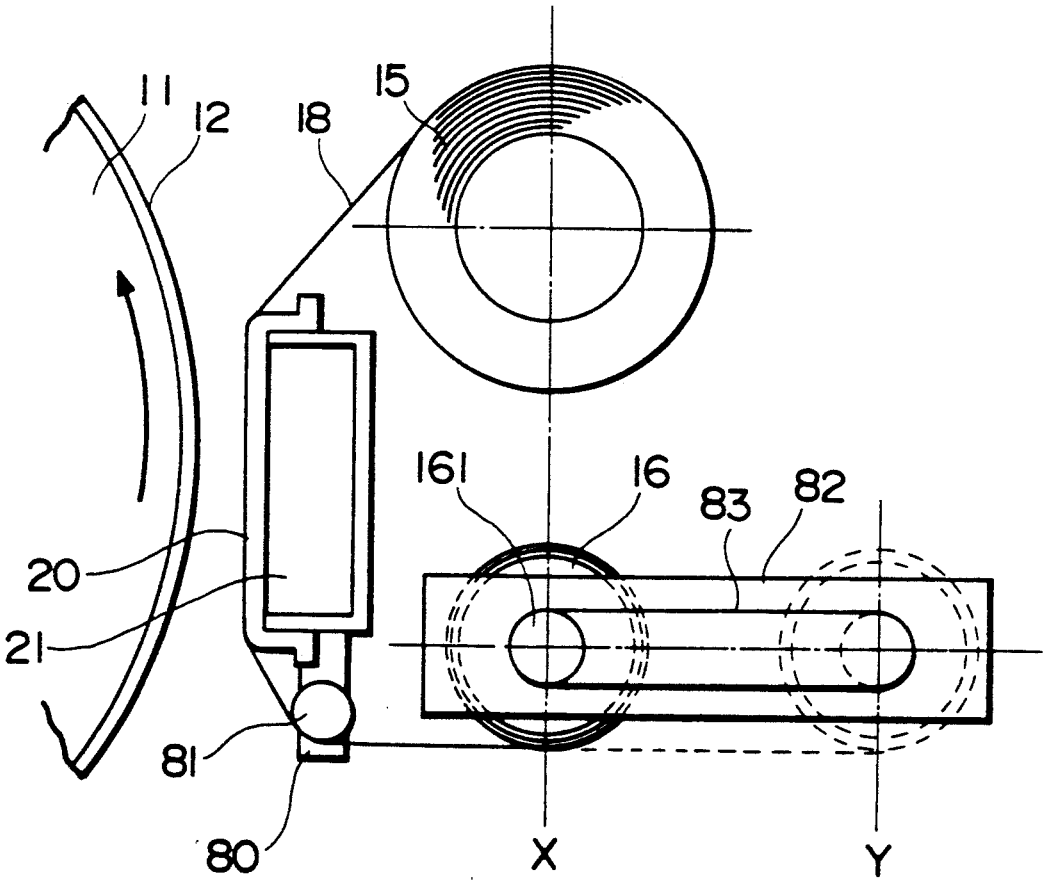
FIG. 25 is an illustration of a fourth embodiment of the present invention.

The construction of this arrangement will be described with reference to FIG. 25. A guide roller 81 is supported at its both ends by the side plates 13 (not shown in FIG. 25) so as to extend in parallel with the cleaning cloth take-up roll 16 at a position between the pressure pad 20 and the cleaning cloth take-up roll 16. The cleaning cloth take-up roll shaft 161 is rotatably supported at its both ends by guide ways 83 of guide frames 82 which are secured to the side plates 13.

The cleaning cloth take-up roll shaft 161 is adapted to be translationally driven by a suitable driving mechanism (not shown) along the guide frames 82, between an initial position X and a stroke end position Y.

Other portions are materially the same as those in conventional systems.

The operation of this embodiment will be described hereinunder with reference to FIGS. 26, 27, 28, 29 and 30.

Figure 26:
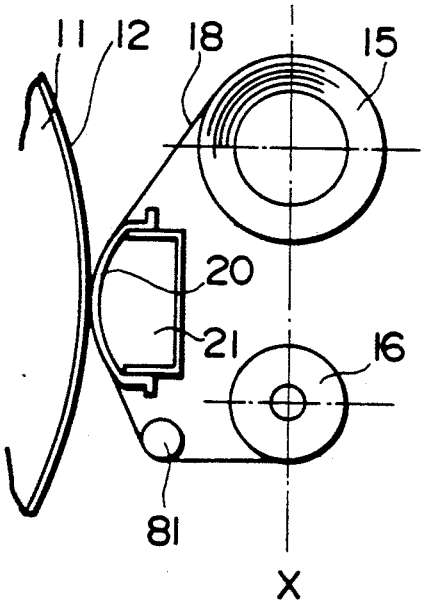
FIGS. 26 to 30 are illustrations of the operation of the fourth embodiment.

Start of Cleaning (See FIG. 26)

As a cleaning start signal is input, water and a cleaning liquid are sprayed onto the cleaning cloth 18 at a spray position which is not shown. Meanwhile, compressed air is supplied into the plenum chamber 21 so as to enable the pressure pad 20 to inflate, thereby pressing the cleaning cloth 18 onto the surface of the blanket 12.

Figure 27:
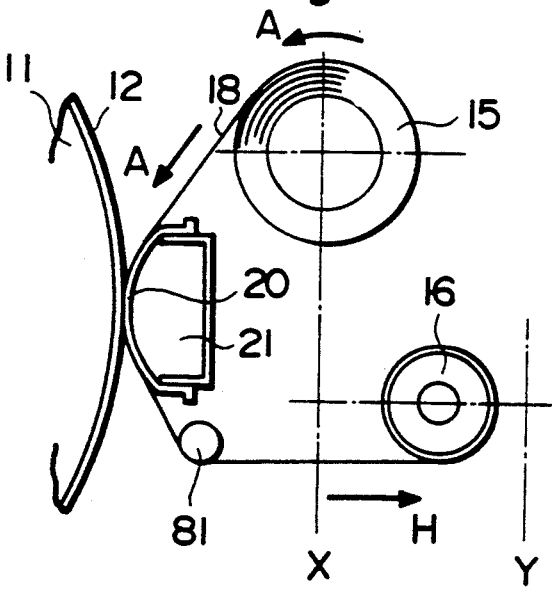

Primary Feed (See FIG. 27)

In this state, the cleaning cloth take-up roll 16 is translationally moved intermittently without rotation, as indicated by an arrow H, whereby the cleaning cloth 18 is fed in the direction of the arrow A.

Figure 28:
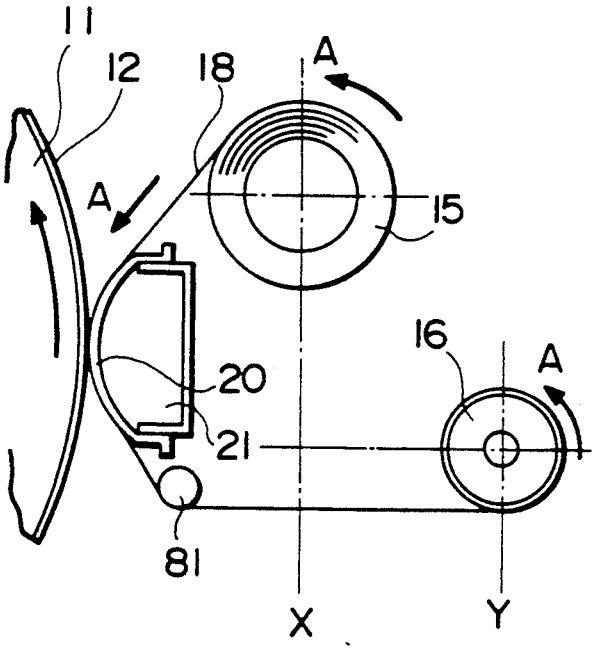

Secondary Feed (See FIG. 28)

When the cleaning cloth take-up roll shaft 16 reaches the stroke end position Y, the cleaning cloth take-up roll 16 is intermittently driven in the direction of the arrow A, so that the cleaning cloth steps in the direction of the arrow A.

Figure 29:
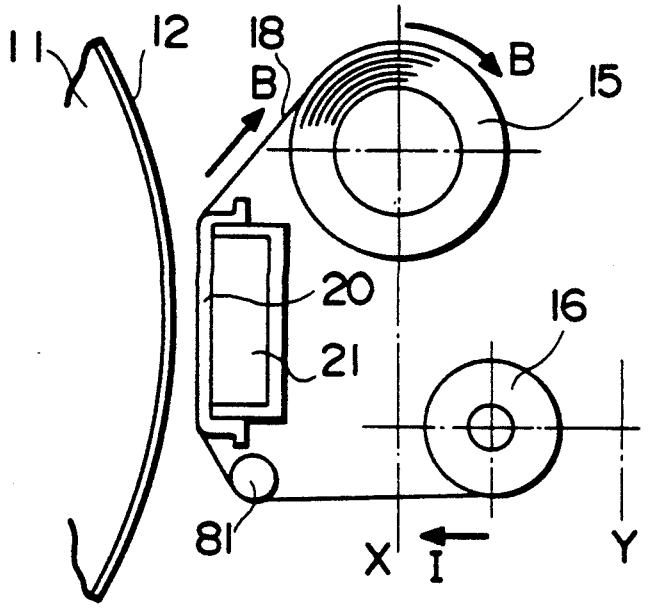

Backward Feed of Cleaning Cloth (See FIG. 29)

The cleaning operation is finished when a predetermined amount of the cleaning cloth 18 is taken-up by the cleaning cloth take-up roll 16. As a result, the air in the plenum chamber 21 is discharged so that the pressure pad 20 deflates so as to move the cleaning cloth 18 away from the blanket 12.

On the other hand, the cleaning cloth take-up roll shaft 161 is moved in the direction of the arrow I from the position Y to the position X. The cleaning cloth take-up roll shaft 161 does not rotate during this movement from the position Y to the position X. In consequence, the slack of the cleaning cloth 18 is taken up by the cleaning cloth supply roll 15 which is urged for rotation in the direction of the arrow B.

Figure 30:
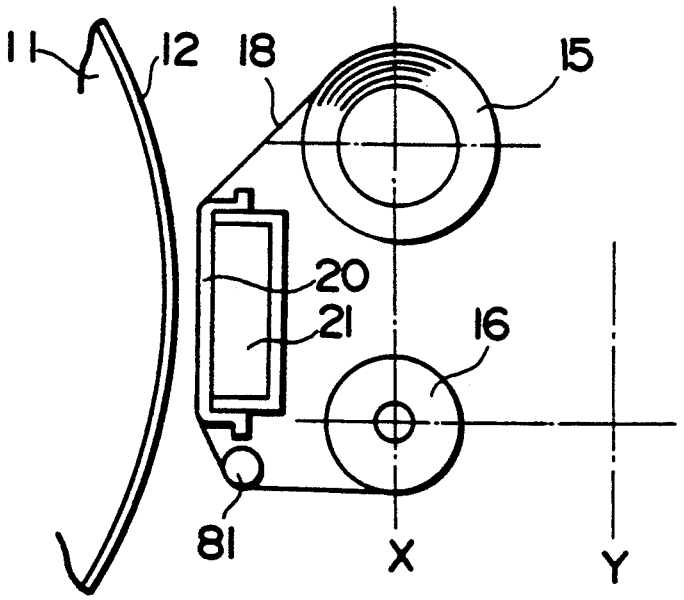

Completion of Whole Cleaning Process and Resetting to Start Position (See FIG. 30)

The whole cleaning process is completed when the cleaning cloth take-up roll 16 is reset to the initial position X with the slack of the cleaning cloth 18 taken up by the cleaning cloth supply roll 15, so that the system is stationed for the next cleaning operation.

FIFTH EMBODIMENT

A description will be made hereinunder with reference to FIGS. 31 and 32 as to a fifth embodiment of the present invention in which the backward feed of the cleaning cloth is effected by reversing the cleaning cloth supply roll by the power of a single motor transmitted through a reversible power transmitting mechanism.

Figure 34:
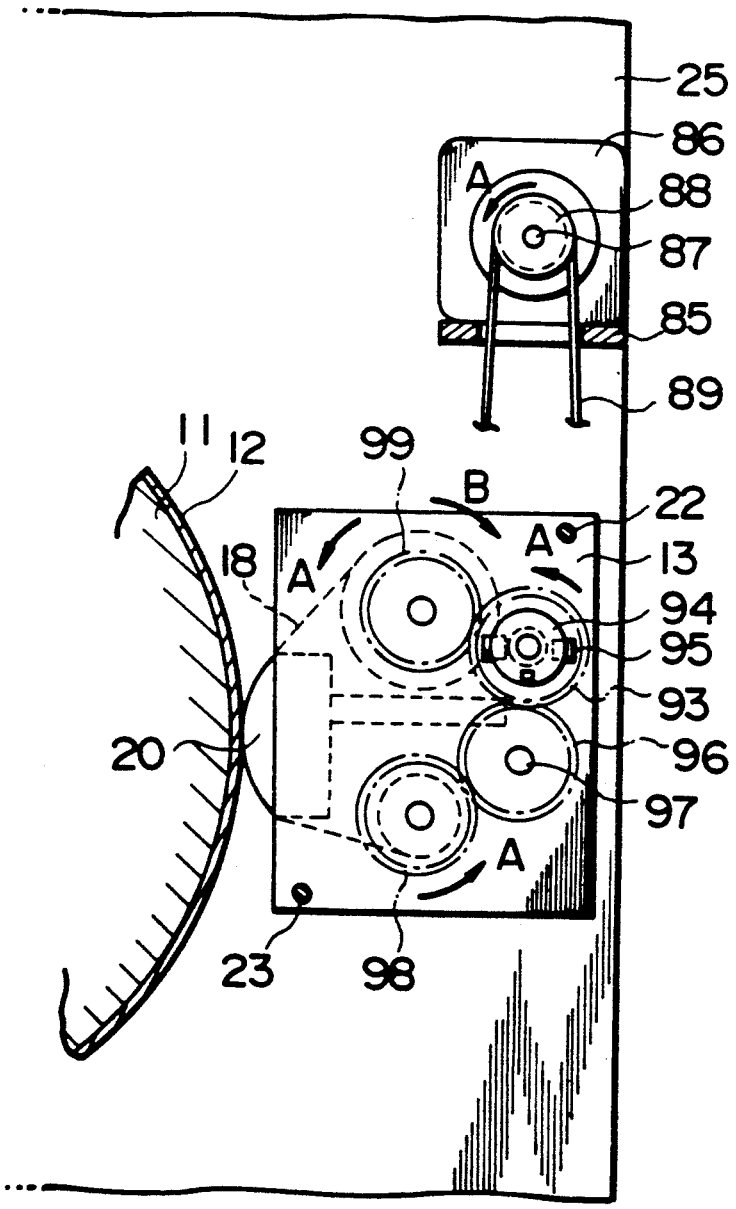
FIG. 34 is a sectional view taken along the line I—I of FIG. 31.

The construction of this embodiment will be described with reference to FIGS. 31, 32 and 34.

The driving and stopping of the cleaning cloth take-up roll shaft 161 is effected by bringing the shift gear 93 into and out of engagement therewith.

The forward rotation of the cleaning cloth supply roll 15 is caused by the force transmitted through the cleaning cloth 18 produced as a result of the forward rotation of the cleaning cloth take-up roll 16.

The reversing of the cleaning cloth supply roll 15 is effected by bringing the shift gear 93 into and out of engagement therewith.

The spline shaft 90 of the shift gear 93 is rotatable only in the direction of the arrow A because it is supported by one-way clutch 92.

The amount or length of forward feed of the cleaning cloth 18 is detected by a detector composed of a rubber wheel 26 and an encoder 22 both of which are not shown.

The sequence of operation of this embodiment will be described with reference to FIGS. 31 and 32.

Figure 31:
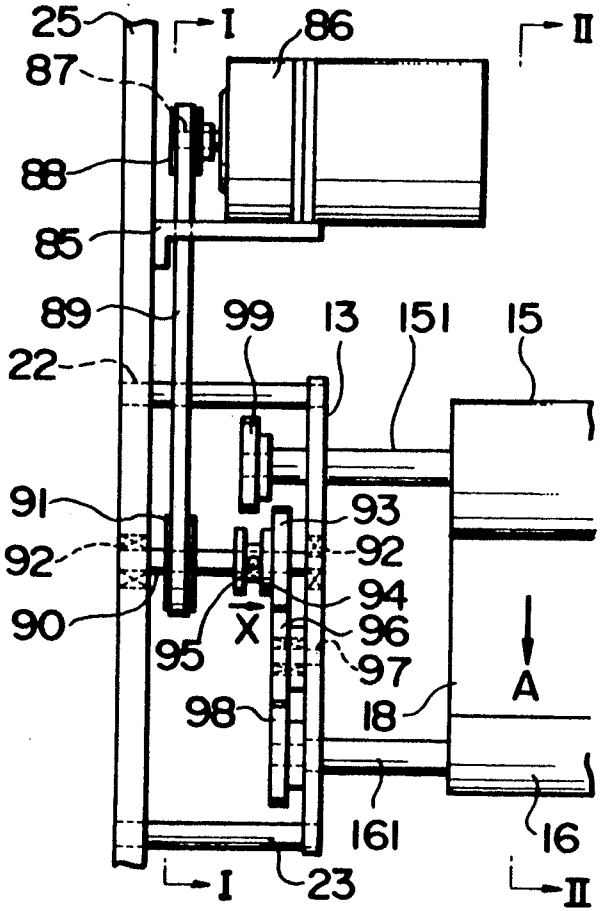
FIG. 31 is a developed front elevational view of a fifth embodiment during the cleaning.
Figure 33:
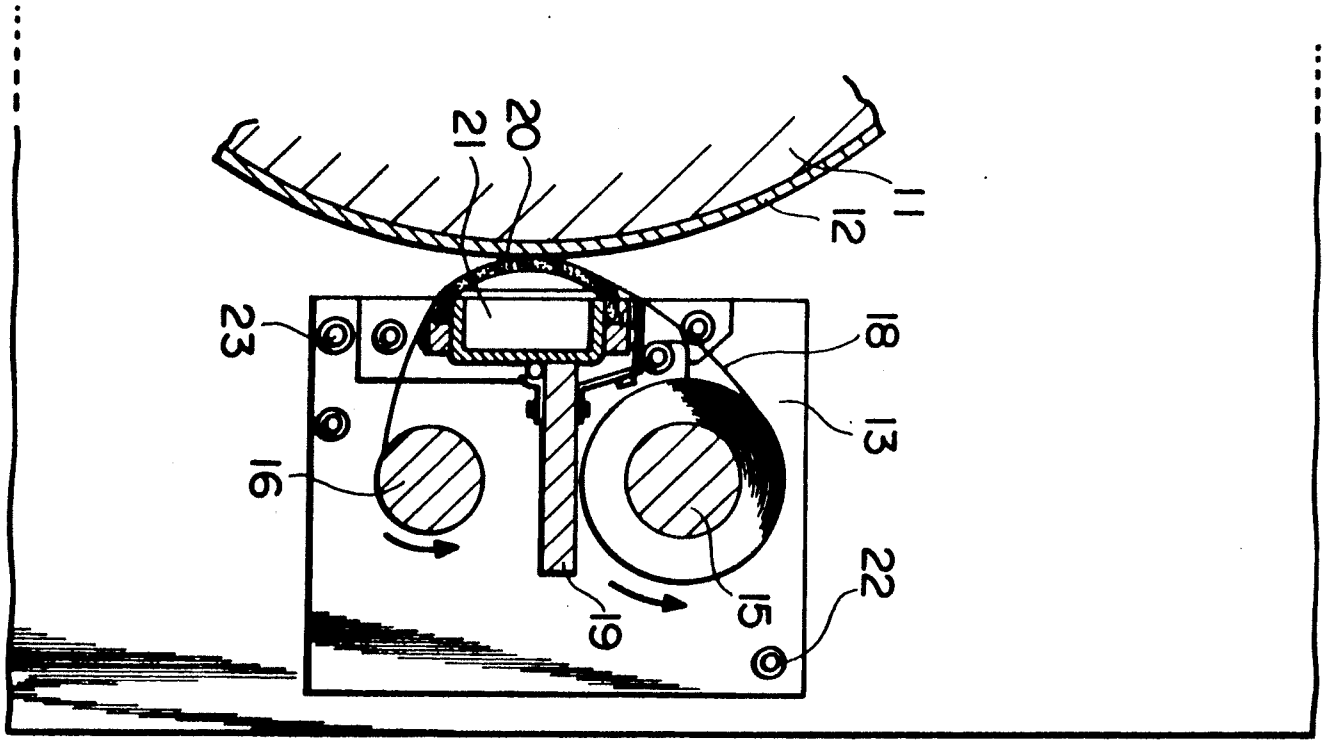
FIG. 33 is a sectional view taken along the line II—II of FIG. 31.

Cleaning (See FIG. 31)

The shift gear 93 is shifted in the direction of the arrow X so as to become able to drive the gear 98 on the cleaning cloth take-up roll shaft through the intermediate gear 96. Thus, the cleaning cloth take-up roll 16 is intermittently driven in the direction of the arrow A.

The gear on the cleaning cloth supply roll does not engage with the shift gear 93 so that it can rotate freely. Therefore, the cleaning cloth supply roll 15 pays away the cleaning cloth 18 in the direction of the arrow A. Meanwhile, the cleaning cloth take-up roll shaft 161 is engaged with the shift gear 93 which has a reversing prevention mechanism, so that the cleaning cloth 18 on the cleaning cloth take-up roll 16 is never extracted therefrom.

The amount or length of feed of the cleaning cloth 18 is detected and controlled by a rubber wheel 26 and an encoder 28.

Figure 32:
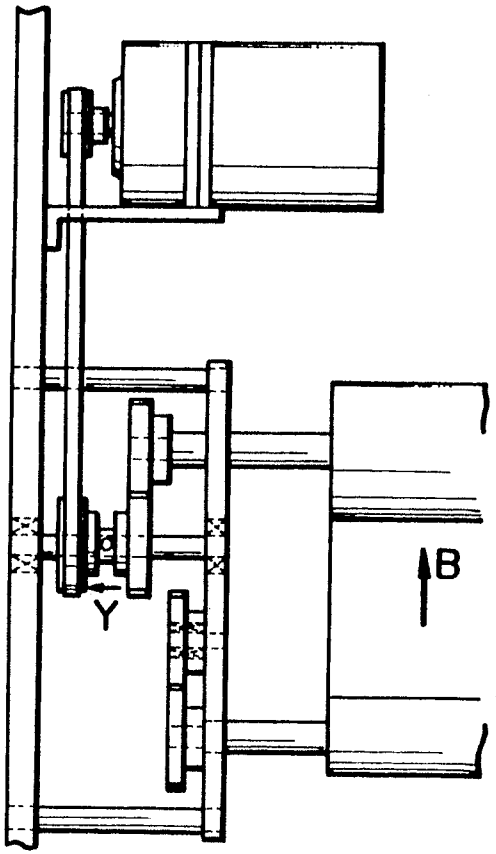
FIG. 32 is a developed front elevational view of the fifth embodiment during reversing of the cleaning cloth.

Backward Feed of the Cleaning Cloth (See FIG. 32)

The shift gear 93 is shifted in the direction of the arrow Y so as to drive the gear 99 on the shaft of the cleaning cloth supply roll 15 thereby reversing the latter in the direction of the arrow B.

Meanwhile, the gear 98 on the shaft of the cleaning cloth take-up roll 16 is disengaged from the shift gear 93 so that the shaft 161 of the cleaning cloth take-up roll is allowed to rotate freely. Therefore, as the cleaning cloth supply roll 15 rotates in the direction of the arrow B, the cleaning cloth 18 is fed in the direction of the arrow B so as to be fed backwardly and rewound and taken-up by the cleaning cloth supply roll 15.

The amount or length of the backward feed of the cleaning cloth is detected by the detecting device composed of the rubber wheel 26 and the encoder 28.

Although the invention has been described through its preferred forms, it is to be understood that the described embodiments are only illustrative and various changes and modifications may be imparted thereto. For instance, the backward feed of a predetermined length of the cleaning cloth towards the cleaning cloth supply end, which is effected by automatic means in the described embodiments, may be executed by a manual mechanism such as a reversing mechanism employing a manually operable lever.

As has been described, according to the present invention, the cleaning cloth which has been forwardly fed for cleaning a cylinder of a printing machine is fed backward partially so as to be used again for the purpose of cleaning the cylinder, whereby the consumption of expensive cleaning cloth is reduced to provide a remarkable effect from the economical point of view.

What is claimed is:

1. A method of cleaning a cylinder comprising: pressing a cleaning cloth onto the outer peripheral surface of said cylinder while said cylinder is rotating; forwardly feeding said cleaning cloth so as to wipe off contaminant on said outer peripheral surface of said cylinder; and partially feeding backwardly the portion of said cleaning cloth which has been fed forwardly during the preceding cleaning operation, before the next cleaning operation is started, whereby said portion of said cleaning cloth is partially used again for the cleaning in the next cleaning operation.

* * * * *

UNITED STATES PATENT AND TRADEMARK OFFICE

CERTIFICATE OF CORRECTION

PATENT NO. : 5,150,653

DATED : September 29, 1992

INVENTOR(S) : Akira Hara

It is certified that error appears in the above-identified patent and that said Letters Patent is hereby corrected as shown below:

On the Title Page:

Insert an asterisk (*) before September 29, 1992 in the Heading;

In the Left Column, after "[73] Assignee: B-J Trading Limited, Tokyo, Japan" insert as a new paragraph --[*] Notice: The portion of the term of this patent subsequent to July 29, 2007, has been disclaimed.--.

Signed and Sealed this

Twelfth Day of October, 1993

Attest:

Bruce Lehman

BRUCE LEHMAN

Attesting Officer

Commissioner of Patents and Trademarks